US011511895B1

(12) United States Patent
L'Heureux et al.

(10) Patent No.: US 11,511,895 B1
(45) Date of Patent: Nov. 29, 2022

(54) CONTAINER CARRIER APPLICATION SYSTEM AND METHOD

(71) Applicants: Kevin Alan L'Heureux, Santa Clarita, CA (US); Keith James Elliott, San Marcos, CA (US); Wayne Gebhardt, Cheney, WA (US)

(72) Inventors: Kevin Alan L'Heureux, Santa Clarita, CA (US); Keith James Elliott, San Marcos, CA (US); Wayne Gebhardt, Cheney, WA (US)

( * ) Notice: Subject to any disclaimer, the term of this patent is extended or adjusted under 35 U.S.C. 154(b) by 21 days.

(21) Appl. No.: 16/950,804

(22) Filed: Nov. 17, 2020

Related U.S. Application Data

(60) Provisional application No. 62/936,744, filed on Nov. 18, 2019, provisional application No. 63/093,856, filed on Oct. 20, 2020.

(51) Int. Cl.
*B65B 17/02* (2006.01)
*B65B 35/30* (2006.01)

(52) U.S. Cl.
CPC ..... *B65B 17/025* (2013.01); *B65B 35/30* (2013.01)

(58) Field of Classification Search
USPC ..... 53/398
See application file for complete search history.

(56) References Cited

U.S. PATENT DOCUMENTS 2,737,326 A 3/1956 Toensmeier
2,874,835 A 2/1959 Ougljesa
2,929,181 A 3/1960 Ougljesa
2,936,070 A 5/1960 Ougljesa
2,997,169 A 8/1961 Ougljesa
(Continued)

FOREIGN PATENT DOCUMENTS

CA 2133827 A1 10/1993
CA 2344436 A1 3/2000
(Continued)

OTHER PUBLICATIONS

International Search Report and Written Opinion dated May 14, 2015, for International Application No. PCT/US2015/010513, 7 pages.

(Continued)

*Primary Examiner* — Chinyere J Rushing-Tucker
(74) *Attorney, Agent, or Firm* — Quickpatents, LLC; Kevin Prince

(57) ABSTRACT

A system for packaging two or more containers with a paperboard carrier having two or more apertures. Each aperture has a plurality of tabs formed at an inside edge thereof that bend upward when contacting a lower edge of a chime of one of the containers. The system includes a platen having apertures for pressing the carrier down uniformly onto the containers and a carrier support configured for maintaining the carrier in the flat configuration as the platen presses the carrier onto the containers substantially simultaneously. Some embodiments of the system include a one-piece manual applicator, while other embodiments include a semi-automatic apparatus that includes a carrier support with retractable carrier support plates and a linear actuator for pressing the platen and carrier down on the containers. A method of use is also disclosed.

29 Claims, 16 Drawing Sheets

(56) References Cited

U.S. PATENT DOCUMENTS

| | | | | |
|---|---|---|---|---|
| 3,073,644 | A | 1/1963 | Baker | |
| 3,094,210 | A | 6/1963 | Van Den Berg | |
| 3,137,109 | A | 6/1964 | Rapata | |
| 3,302,364 | A | 2/1967 | Rice | |
| 3,317,234 | A | 5/1967 | Burford | |
| 3,353,729 | A | 11/1967 | Hull | |
| 3,383,827 | A | 5/1968 | Schaich | |
| 3,867,807 | A | 2/1975 | Doucette | |
| 3,897,873 | A | 8/1975 | Graser | |
| 3,912,075 | A | 10/1975 | Berry | |
| 3,977,150 | A | 8/1976 | Culpepper | |
| 4,111,298 | A | 9/1978 | Mascia | |
| 4,120,396 | A | 10/1978 | Mascia | |
| 4,121,401 | A | 10/1978 | Duerr | |
| 4,136,772 | A | 1/1979 | Mascia | |
| 4,190,149 | A | 2/1980 | Oliff | |
| 4,213,283 | A | 7/1980 | Calvert | |
| D265,979 | S | 8/1982 | Arfert | |
| 4,453,630 | A | 6/1984 | Helms | |
| 4,641,483 | A | 2/1987 | Yamauchi | |
| 5,125,506 | A | 6/1992 | Galbierz | |
| 5,178,266 | A | 1/1993 | Villa | |
| 5,186,321 | A | 2/1993 | Fadus | |
| 5,188,225 | A | 2/1993 | Jorba | |
| 5,193,673 | A | 3/1993 | Rathbone | |
| 5,237,796 | A | 8/1993 | Bonkowski | |
| 5,263,299 | A | 11/1993 | Galbierz | |
| 5,282,348 | A | 2/1994 | Dampier | |
| 5,310,051 | A | 5/1994 | Sutherland | |
| 5,318,178 | A | 6/1994 | Davies | |
| 5,320,216 | A | 6/1994 | Pangborn | |
| 5,355,999 | A | 10/1994 | Sutherland | |
| 5,415,278 | A | 5/1995 | Sutherland | |
| 5,425,446 | A | 6/1995 | Weaver | |
| 5,443,153 | A | 8/1995 | Sutherland | |
| 5,445,262 | A | 8/1995 | Sutherland | |
| 5,474,172 | A | 12/1995 | Zavatone | |
| 5,487,464 | A | 1/1996 | Galbierz | |
| 5,490,593 | A | 2/1996 | Gordon | |
| 5,526,925 | A | 6/1996 | Bernstein | |
| 5,551,566 | A | 9/1996 | Sutherland | |
| 5,553,704 | A | 9/1996 | Gordon | |
| 5,553,705 | A | 9/1996 | Bakx | |
| 5,573,111 | A | 11/1996 | Gordon | |
| 5,590,776 | A | 1/1997 | Galbierz | |
| 5,609,247 | A | 3/1997 | Appleton | |
| 5,706,936 | A | 1/1998 | Bernstein | |
| 5,711,419 | A | 1/1998 | Beales | |
| 6,059,099 | A | 5/2000 | Galbierz | |
| 6,076,331 | A * | 6/2000 | Granbakken | B65B 17/025 53/398 |
| 6,293,392 | B1 | 9/2001 | Galbierz | |
| 6,394,272 | B1 | 5/2002 | Domansky | |
| 6,874,620 | B2 | 4/2005 | Mattson | |
| 7,108,128 | B2 | 9/2006 | Borg | |
| 7,163,103 | B2 | 1/2007 | Bakx | |
| 7,377,382 | B2 | 5/2008 | Borg | |
| 7,823,721 | B2 | 11/2010 | Sutherland | |
| 7,823,943 | B2 | 11/2010 | Borg | |
| 8,096,413 | B2 | 1/2012 | Coltri De Paula | |
| 8,256,617 | B2 | 9/2012 | Gomes | |
| 8,297,438 | B2 | 10/2012 | Crossman | |
| 8,353,398 | B2 | 1/2013 | DePaula | |
| 8,387,784 | B2 | 3/2013 | Gonzalez | |
| 8,443,968 | B2 | 5/2013 | De Paula | |
| 8,464,866 | B2 | 6/2013 | Sutherland | |
| 8,631,932 | B2 | 1/2014 | Holley, Jr. | |
| 8,701,878 | B2 | 4/2014 | Spivey, Sr. | |
| 8,936,148 | B2 | 1/2015 | Olsen | |
| 8,936,149 | B2 | 1/2015 | Smalley | |
| 9,079,699 | B2 | 7/2015 | Holley, Jr. | |
| 9,169,050 | B2 | 10/2015 | Spivey, Sr. | |
| 9,359,093 | B2 | 6/2016 | DePaula | |
| 9,511,916 | B2 | 12/2016 | Holley, Jr. | |
| D854,424 | S | 7/2019 | Lauria | |
| 2004/0206639 | A1 | 10/2004 | Karlsson | |
| 2009/0101526 | A1 | 4/2009 | Sutherland | |
| 2012/0073997 | A1 | 3/2012 | Borg | |
| 2012/0227361 | A1 | 9/2012 | Bates | |
| 2014/0027318 | A1 | 1/2014 | Sutherland | |
| 2014/0300026 | A1 | 10/2014 | Taccolini | |
| 2015/0191287 | A1 | 7/2015 | L'Heureux | |
| 2016/0325899 | A1 | 11/2016 | L'Heureux | |
| 2018/0222650 | A1 | 8/2018 | Zacherle | |
| 2018/0319521 | A1 * | 11/2018 | Merrick | B65B 35/56 |
| 2018/0362234 | A1 | 12/2018 | L'Heureux | |
| 2019/0119019 | A1 | 4/2019 | Patton | |
| 2019/0135512 | A1 | 5/2019 | Kooc | |
| 2019/0233145 | A1 * | 8/2019 | Kooc | B65B 17/025 |
| 2020/0010255 | A1 | 1/2020 | Zacherle | |
| 2020/0056335 | A1 | 2/2020 | Chung | |
| 2020/0079564 | A1 | 3/2020 | Ford | |
| 2020/0189817 | A1 | 6/2020 | Smalley | |
| 2020/0189818 | A1 | 6/2020 | McCree | |
| 2020/0189819 | A1 | 6/2020 | McCree | |
| 2020/0189820 | A1 | 6/2020 | Smalley | |
| 2020/0189821 | A1 | 6/2020 | Smalley | |
| 2020/0189822 | A1 | 6/2020 | Smalley | |
| 2021/0261279 | A1 * | 8/2021 | Zacherle | B65B 35/30 |

FOREIGN PATENT DOCUMENTS

| | | | |
|---|---|---|---|
| CA | 2341999 | A1 | 9/2001 |
| CA | 2738228 | A1 | 4/2010 |
| CA | 2925243 | A1 | 9/2016 |
| CA | 2875398 | C | 2/2017 |
| CN | 100408442 | C | 8/2008 |
| CN | 101861276 | B | 4/2012 |
| CN | 104471336 | A | 3/2015 |
| CN | 109328171 | A | 2/2019 |
| EP | 188327 | | 1/1986 |
| EP | 636096 | A1 | 2/1995 |
| EP | 889836 | | 3/1997 |
| EP | 1384679 | B1 | 9/2005 |
| EP | 1919793 | B1 | 12/2010 |
| EP | 2125558 | B1 | 9/2011 |
| FR | 2363493 | A1 | 3/1978 |
| GB | 1333960 | A | 10/1973 |
| JP | 2012532808 | A | 12/2012 |
| JP | 2013514946 | A | 5/2013 |
| JP | 5244193 | B2 | 7/2013 |
| JP | 3186355 | U | 10/2013 |
| JP | 5474099 | B2 | 4/2014 |
| JP | 6608641 | B2 | 11/2019 |
| KR | 20200014665 | A | 2/2020 |
| WO | 9600687 | A1 | 1/1996 |
| WO | 2004054411 | A1 | 7/2004 |
| WO | 2008001971 | A1 | 1/2008 |
| WO | 2015105901 | A1 | 7/2015 |
| WO | 2016199970 | A1 | 12/2016 |
| WO | 2016200065 | A1 | 12/2016 |
| WO | 2017018545 | A1 | 2/2017 |

OTHER PUBLICATIONS

Non-Final Office Action dated Apr. 6, 2017 of U.S. Appl. No. 14/591,495 by L'Heureux ,K.A., et al., filed Jan. 7, 2015.

Restriction Requirement dated Feb. 27, 2016 of U.S. Appl. No. 14/591,495 by L'Heureux ,K.A., et al., filed Jan. 7, 2015.

U.S. Appl. No. 14/591,495 by L'Heureux ,K.A , et al., filed Jan. 7, 2015.

International Search Report and Written Opinion dated May 14, 2015, for International Application No. PCT/US2015/010513, 6 pages.

Non-Final Office Action dated Jul. 28, 2017 of U.S. Appl. No. 15/109,808 by L'Heureux, K. A., et al., filed Jul. 5, 2016.

Fishbone Packaging Inc., available Oct. 19, 2016, [online], [site visited Jul. 25, 2019]. Available from internet, URL: https://web.archive.org/web/20161019103118/http://www.fishbonepackaging.co/ (Year: 2016).

(56) References Cited

OTHER PUBLICATIONS

Fishbone Packaging Inc., available Feb. 10, 2016, [online], [site visited Jul. 25, 2019]. Available from internet, URL: https://web.archive.org/web/20160210131122/http://www.fishbonepackaging.co/ (Year: 2016).
Cup carrier, Cardboard, 6 compartments, available Jul. 25, 2019, [online], [site visited Jul. 25, 2019]. Available from internet, URL: https://www.vanderwindtverpakking.nl/en_US/p/cup-carrier-cardboard-6-compartments/16855/ (Year: 2019).
6 Hole Steam Table Adapter Plate—4 3/4", available Oct. 16, 2015, [online], [site visited Jul. 25, 2019]. Available from internet, URL: http://www.webstaurantstore.com/6-hole-steam-table-adapter-plate-4-3-4/922ADP444.html (Year: 2015).
Draagtrays Karton voor 6 glazen Wit—150 st/ds., available Jul. 25, 2019, [online], [site visited Jul. 25, 2019], Available from internet URL: https://www.disposabledirect.nl/draagtrays-karton-voor-6-glazen-150-st-ds.html (Year: 2019).

* cited by examiner

CONTAINER CARRIER APPLICATION SYSTEM AND METHOD

CROSS-REFERENCE TO RELATED APPLICATIONS

This application claims the benefit of U.S. Provisional Patent Application 62/936,744, filed on Nov. 18, 2019, and U.S. Provisional Patent Application 63/093,856, filed on Oct. 20, 2020, both incorporated herein by reference.

STATEMENT REGARDING FEDERALLY SPONSORED RESEARCH AND DEVELOPMENT

Not Applicable.

FIELD OF THE INVENTION

This invention relates to packaging, and more particularly to packaging of beverage or food containers.

BACKGROUND

The term "carrier" as used herein refers to any carrying means that, in combination with a container, allows for the transport of the container.

The term "container" as used herein, refers to any container that includes a neck or chime portion on the container that is adapted for receiving a carrier having a container-engaging opening. The container may hold a liquid, for example, a beverage, or a non-beverage such as snacks. The container may also be referred to herein as a vessel canister, can, jar, bottle, or other sealed receptacles. Common containers are made with metal, glass, plastic, molded pulp, aluminum, or paper, or the like The term "tab" refers to protruding areas inside apertures of the carrier that once bent upwardly connect with the chime of the container to temporarily couple the carrier with the container until it is forcibly removed.

The term "neck" refers to a collar on a can, bottle or other container type. The portion of the collar or chime that is closest to the neck of the container defines a ledge, the lower side of the chime, that is supported by the carrier.

The term chime is the area of the container that is turned in on itself to provide a safe finished curved edge, flange, or hem at the top or lid of the container. The chime provides the ledge that is supported by the carrier.

There are many types of multi-packing carriers in the beverage and non-beverage container industry. The beverage and non-beverage carriers are often circular plastic ring carriers, commonly known as six pack rings, which package together a plurality of like sized containers into a single article that is easier to carry than the individual containers. Some circular plastic rings or "multi-packaging rings" are injected molded or extruded, but are more commonly fabricated from flat, thin gauge sheets of plastic. Circular plastic ring carrying devices such as the low-density polyethylene (LDPE), high density polyethylene (HDPE) and other circular plastic type carriers are common in the market, and yet they are loathed by manufacturers and consumers alike. Such plastic ring carriers are available in a variety of configurations, dimensions and shapes such as square, circular, triangular and other shapes. There are other types of multi-packaging systems to carry beverages and non-beverages containers. Some examples are paper cartons, corrugated containers, boxes, wax boxes, folding cartons, beverage baskets, molded pulp, plastic or other like materials.

Circular plastic rings and multi-packaging carriers that package a plurality of containers by their necks or chimes and allow the containers to be carried are well known. These circular plastic rings and multi-packaging carriers are commonly used to secure cans or containers through the manufacturing, supply, inventory, distribution, retail and consumer use chain. The most common use of these circular plastic ring carriers and multi-packaging carriers are in supermarkets, convenience stores, the food delivery industry, and other retail locations.

Such common circular plastic ring multi-packaging systems often secure containers of soda, beer, juice, water, energy drinks and other liquids and are typically manufactured for a variety of containers and various plural configurations such as two, four, six, eight, etc., for in-line configurations such as two rows, three rows, etc. The low-density polyethylene (LDPE) carrying devices and the high-density polyethylene (HDPE) carrying devices currently being manufactured are an inherent danger to the environment and a frustration point to both manufactures and customers. These circular plastic ring multi-packaging systems clog waterways and landfills once discarded. Wildlife animals are often severely injured or killed due to entrapment or ingestion of such circular plastic rings.

Furthermore, the plastic material utilized to manufacture such devices breaks down over time in a variety of processes including photo-degradation and transforms into microscopic pieces commonly referred to as micro-plastics. These plastics derivatives pollute landfills, ocean eco-systems and are commonly ingested by land animals, birds, ocean and sea life as small as phytoplankton thus eventually making their way back through our food supply chain as well as into our drinking water with ill health effects in humans having been observed. Such traditional circular plastic ring beverage carrying devices may become malformed and lose elasticity when exposed to light due to photo-degradation (UV exposure), or due to heat and other factors, often causing containers to dislodge from the caring device, causing product damage or loss. Such circular plastic rings have resulted in major environmental concerns, and this type of packaging is becoming less desirable or outright banned from the marketplace by some jurisdictions.

Manufacturers, retailers and consumers are looking for multi-packaging carrier solutions that leave a smaller carbon footprint. Using less material, or using materials that are biodegradable or recyclable, results in less damage to the environment and would be preferable. This has caused retail businesses and manufacturers to look for alternative biodegradable, recyclable, and low material use packaging solutions for carrying beverage and non-beverage containers. There is a need for an apparatus and method for efficiently and accurately applying such a biodegradable, recyclable carrier that uses less material for carriers for containers. The present invention accomplishes these objectives.

SUMMARY OF THE INVENTION

The present device is a system for packaging two or more containers of the type having a body, a neck, and a lid with a chime with a lower edge. When the chimes of the containers are all aligned in a horizontal plane, the containers can be packaged together with a carrier of the type having two or more apertures, each aperture for receiving the chime and neck of one of the containers. Each aperture has a plurality of tabs formed at an inside edge of the aperture.

Each tab is configured for bending upward when contacting the lower edge of the chime of one of the containers.

Some embodiments of the system include a manual applicator, while other embodiments include a semi-automatic apparatus. All embodiments include a platen having apertures for pressing the carrier down uniformly onto the containers. Importantly, the carrier must remain in a flat configuration when applied to the containers. Accordingly, each embodiment of the system includes a carrier support configured for maintaining the carrier in the flat configuration as the platen presses the carrier onto the containers substantially simultaneously.

In use, with the carrier supported with the carrier support in the flat configuration, the platen presses the carrier onto the containers uniformly and simultaneously. The tabs of the carrier deform upwardly substantially simultaneously to pass the chimes of the containers, each tab abutting the lower edge of the chime of one of the containers to hold the containers together with the carrier. The platen is thereafter withdrawn from the carrier and the containers to release the carrier and the containers.

In embodiments having the manual applicator, preferably the platen is integrally formed with the carrier support, and a skirt is included that has a slot configured for receiving the carrier therethrough to the carrier support, which is preferably four corner supports that help maintain the carrier, and particularly corners of the carrier, in the flat configuration. Once the carrier is engaged with the containers, the manual applicator is pulled upward away from the carrier and containers, whereby the corners of the carrier are forced to bend upward slightly until the corners are able to clear the four corner supports, releasing the carrier and the containers.

In embodiments having the semi-automatic apparatus, the carrier support includes at least one carrier retainer plate movable between an engaged position wherein the at least one carrier retainer plate engages and supports the carrier, and a disengaged position wherein the at least one carrier retainer plate is retracted away from and disengages from the carrier. Each carrier retainer plate is fixed with a carrier mount. In some embodiments, each carrier retainer plate is slidably fixed with the carrier mount. In other embodiments, each carrier retainer plate is rotatably fixed with the carrier mount at a pivot joint. In embodiments wherein the at least one carrier retainer plate is movable with respect to the carrier mount, preferably pneumatic or electric actuators are included to move the at least one carrier retainer plate, through mechanical linkages, between the engaged position and the disengaged position.

In such semi-automatic embodiments, preferably at least a pair of guides are included, fixed orthogonally with a base. Such guides may be guide rods, guide tracks, or the like, and are used to guide the platen and carrier support vertically down onto the containers. Accordingly, the carrier mount has at least a pair of slide mechanism each for engaging one of the guides. Similarly, with the platen fixed with a platen mounting plate, the platen mounting plate also includes at least a pair of the slide mechanism, each for engaging one of the guides above the carrier mounting plate. The platen is thereby slidably fixed with the guides above the carrier retainer plates and the carrier mount.

As such, with the carrier retainer plates in the engaged position and engaged with the carrier, and with the containers each supported on the base and aligned to receive the carrier, the platen mounting plate is moved downward, guided by the guides, until the platen engages the carrier. The platen mounting plate and the carrier mount are then moved downwardly together until the tabs of the apertures of the carrier contact the chimes of the containers. Thereafter, the tabs of the apertures of the carrier are bent upward under downward pressure from the platen until each tab engages the neck and the lower edge of the chime of one of the containers.

At this point the carrier retainer plates are retracted to release the carrier from the carrier support. The carrier mount and platen mounting plate are thereafter raised to clear the carrier and the containers, such that the carrier and the containers, now packaged together, can be removed.

The semi-automatic apparatus preferably includes at least one linear actuator fixed with the platen mounting plate and adapted to raise and lower the platen mounting plate and platen between a raised position wherein the platen and carrier support clear the containers, and a lowered position wherein the carrier and platen engaged the containers. A controller may be electrically connected with a switch that, when actuated, causes the controller to lower the platen mount from the raised position towards the containers.

Vertically adjustable mechanical stops may be included to prevent downward travel of the platen and carrier support below the lowered position. Alternately, the controller is electrically connected with a proximity sensor adapted to detect when the chime of one of the containers reaches a predetermined position with respect to the platen, at which point the controller raises the platen mount to the raised position. Preferably the proximity sensor is a laser distance sensor mounted with the platen or the platen mounting plate and adapted to return a distance range between the laser distance sensor and the lid of one of the containers. As such the controller is programed to return to the raised position upon reaching a user-set lowered position that is based on a height of the containers.

The present invention is a multiple container carrier solution that leaves a relatively small carbon footprint, uses relatively little material, and can use materials that are biodegradable or recyclable, results in less damage to the environment. The present apparatus and method efficiently and accurately applies such a biodegradable, recyclable, low material use carrier to any number of containers, as desired. The present invention can be scaled from a single-piece manual applicator to a higher-capacity semi-automatic apparatus. The present device provides for securely holding multiple containers with the carrier that is quickly and easily applied to the containers.

The present invention allows for the application of non-plastic, fibrous, paperboard materials that have lower tensile strength, density and caliper thickness, which might otherwise tear or break with previous methods. Such materials are successfully applied with the present system in both a manual, one-at-a-time (single) application process, as well as a semi-automated and high-speed application processes. Previously, only plastic, non porous material solutions have been available to perform such a duty.

Paperboard based material have not previously been able to replace malleable (LDPE) or rigid (HDPE) plastics for neck engaging carrier solutions due to the inherent tendency for such materials to tear or otherwise fail during container application. Accordingly, heretofore paperboard material has been limited to implementations such as full wraparound cartons, and the like, where a multitude of containers are supported on multiple sides and bottom for secure support. Those solutions utilize an increased amount of material and glue application, which is drastically reduced or eliminated with the present invention.

The use of the present invention allows for the use of recyclable, biodegradable materials to be successfully utilized in multipack container packaging systems in a secure and functional format not previously available. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 1:
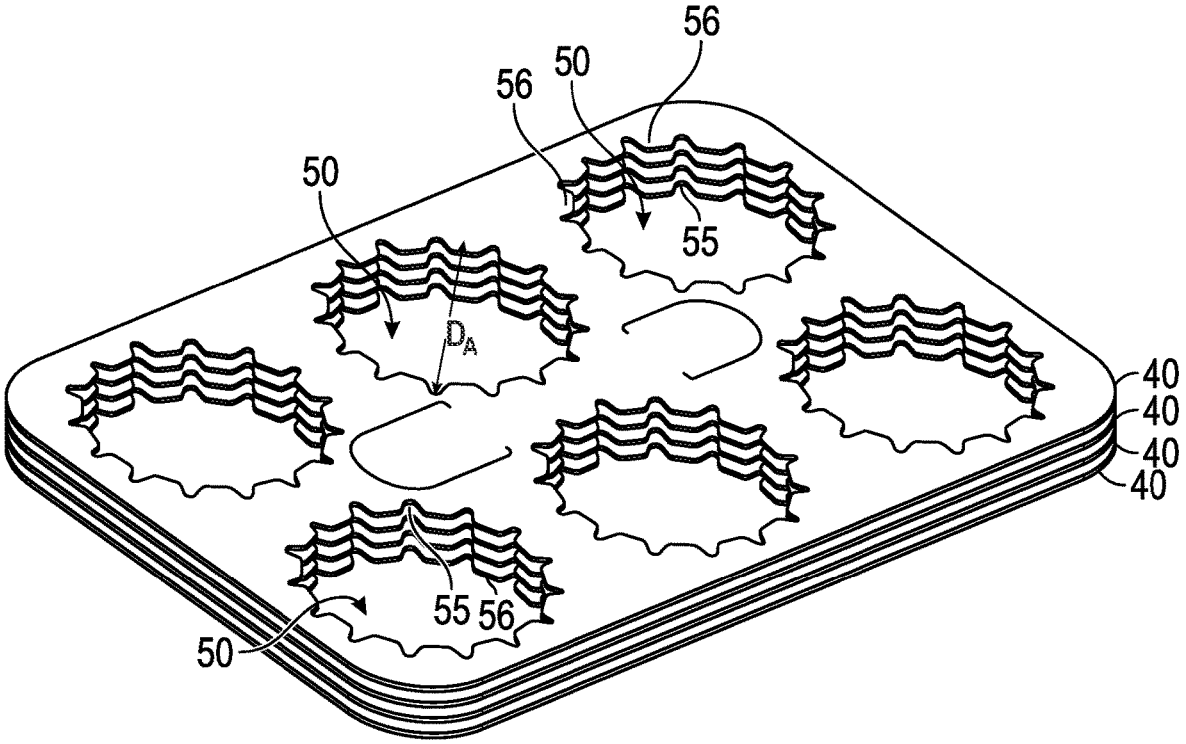
FIG. 1 is a perspective view of a stack of carriers of the invention.

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

FIGS. 1, 2A, 6 and 7 illustrate a system 10 for packaging two or more containers 20 of the type having a body 25, a neck 26, and a lid 28 with a chime 27 with a lower edge 29. When the chimes 27 of the containers 20 are all aligned in a horizontal plane 30 (FIGS. 5A and 8), the containers 20 can be packaged together with a carrier 40 of the type having two or more apertures 50, each aperture 50 for receiving the chime 27 and neck 26 of one of the containers 20. Each aperture 50 has a plurality of tabs 56 formed at an inside edge 55 of the aperture 50. Each tab 56 has a length $L_T$ and a thickness $T_T$, and is configured for bending upward when contacting the lower edge 29 of the chime 27 of one of the containers 20 (FIGS. 4A-5B and 16). Preferably a ratio of the thickness $T_T$ of each tab to the length $L_T$ of each tab is between 0.448 and 0.100, and ideally at 0.274, so that each tab 56 is sufficiently resilient and does not crease or deform under pressures normally applied by the system 10 and by transporting of the packaged containers 20.

Preferably each tab 56 is formed in a generally trapezoidal shape (FIG. 4A) with gaps 43 being defined therebetween. Other shapes of the tabs 56, such as parallelograms (FIG. 4B) may be utilized, but it has been found that the trapezoidal shaped tabs 56 maintain desired strength during use, which results in the containers 20 being held within the carrier 40 during normal transport and handling. To remove a container from the carrier 40, the container 20 and carrier 40 may be manually, forcefully separated, or the carrier 40 may be manually torn.

Figure 3:
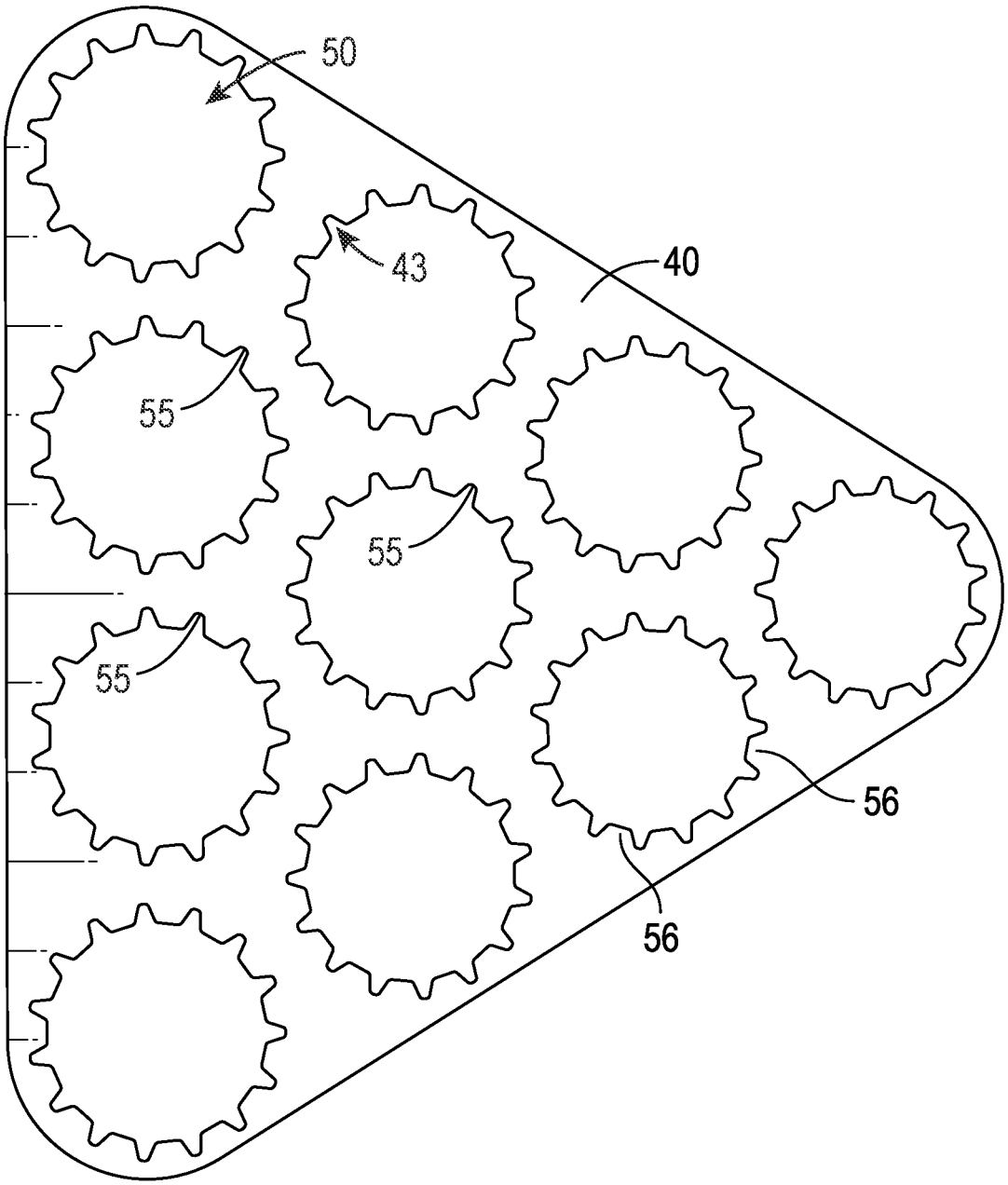
FIG. 3 is an alternate embodiment having a triangular-shaped carrier.
Figure 4A:
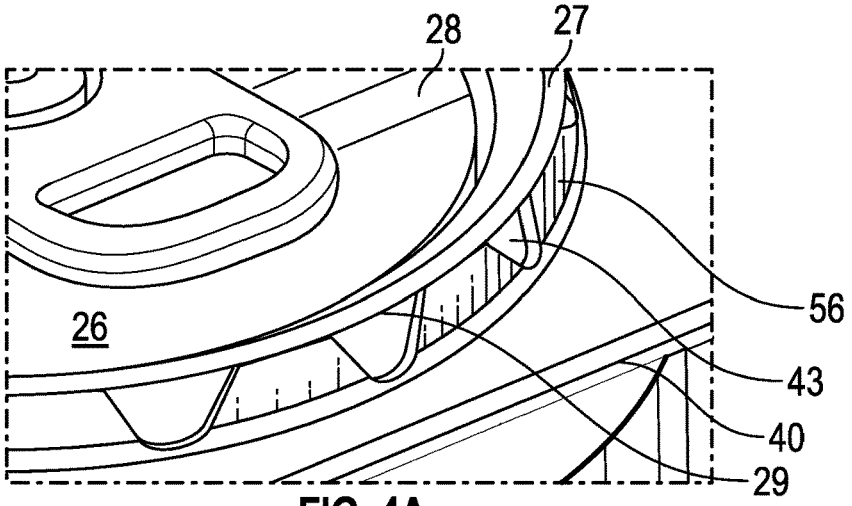
FIG. 4A is an enlarged, partial perspective view of a carrier having upwardly-bent tabs contacting a chime of one of the containers.
Figure 4B:
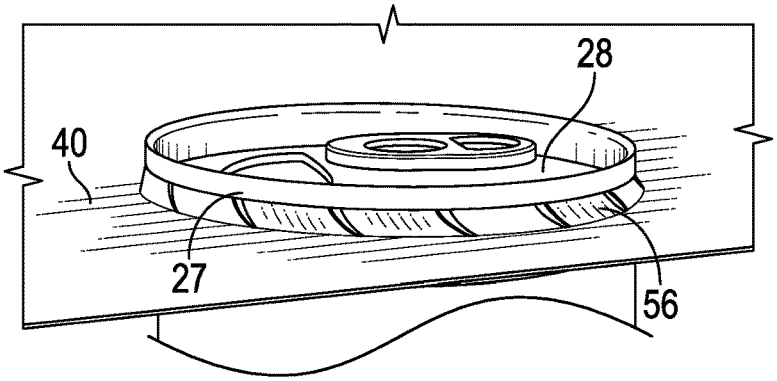
FIG. 4B is an enlarged, partial perspective view of a carrier having alternate tabs.

In some embodiments the system 10 includes the carrier 40, while in other embodiments the system 10 utilizes carriers 40 that are sold separately. Either way, the number of apertures 50 in the carrier 40 determines the number of containers 20 that are packaged together thereby. The carrier 40 is preferably a paper-based material that is semi-resilient, easily die-stamped, biodegradable, recyclable, and that can permanently receive printed indicia thereon. The carrier 40 is preferably die-cut, die-stamped, laser cut, or otherwise formed as is or becomes known in the art. In some embodiments the carrier 40 may include finger cut-outs 41 (FIG. 2A) for facilitating carrying of the carrier 40 and containers 20 with a person's thumb and finger (not shown). The carrier 40 may be any suitable shape, such as rectangular for holding six containers 20 (FIGS. 1 and 2A), for example, in two rows of three containers 20 each, square for holding four containers 20, for example, in two rows of two containers each (FIGS. 6 and 7), triangular (FIG. 3) for holding ten containers in a triangular pattern, for example, and so forth. Any suitable shape, even irregular shapes, of carriers 40 may be used.

The carrier 40 of the present invention uses less material than prior art carton solutions, and further displays more of the container body 25. Showing more of the container body 25 allows a larger viewing area for brand graphics (not shown) on the container 20. This is both a benefit to the consumer and to the manufacturer, providing the consumer a better understanding of the benefits and the use of the product packaged within the container 20.

The carrier 40 is preferably manufactured from a kraft carrier board with a wet-strength coating to allow for more rigid material qualities at relatively reduced thickness $T_T$ (FIG. 5A), which helps increase strength of the carrier 40, though the material tends to be costlier than other common kraft board materials available in the market. Such a material preferably has a thickness $T_T$ ranging from a minimum or 0.018 inches +/−5%. to a maximum of 0.030 inches +/−5%. Such a material is preferably made of long-fibrous pulp strands comprising 100% virgin fiber with a clay topcoat.

Such board materials allow an expanded variety of further reduced board thickness $T_T$, to be utilized for the manufacture of product which is able to carry a higher weight per square inch compared to traditionally-manufactured wet-strength board material, as well as a highly reduced carbon footprint comparatively. Such a board material is preferably made of a high concentration of virgin fiber inclusive of hardwood materials and utilizes a reduced amount of bonding agents in its construction, increasing recyclability. Such a material preferably has a minimum weight of about 330 g/m2+/−5% with a minimum thickness $T_T$ of about 510 microns +/−5% to a maximum weight of about 460 g/m2+/−5% with a maximum thickness $T_T$ of about 745 microns +/−5%. Such a substrate material provides an increase bending resistance of between 805 to 1850 MD mN, L&W at 15o and an increased tearing resistance of between 7,200 and 12,000 GM mN.

Coatings are preferably added as part of a paper board manufacturing/converting process in order to add moisture resistance on either side of the material. Such coatings may be made from various base substances such as an aqueous (water based coating), bio-based coating, UV coatings, petroleum based coating, clay including but not limited to china clay, calcium carbonate, titanium dioxide or a variety of commercially available and future coating materials. For example, some preferred embodiments including a VpCI-144 coating having a WTR (g/hour*m2) of 0.61-0.69.

Figure 5A:
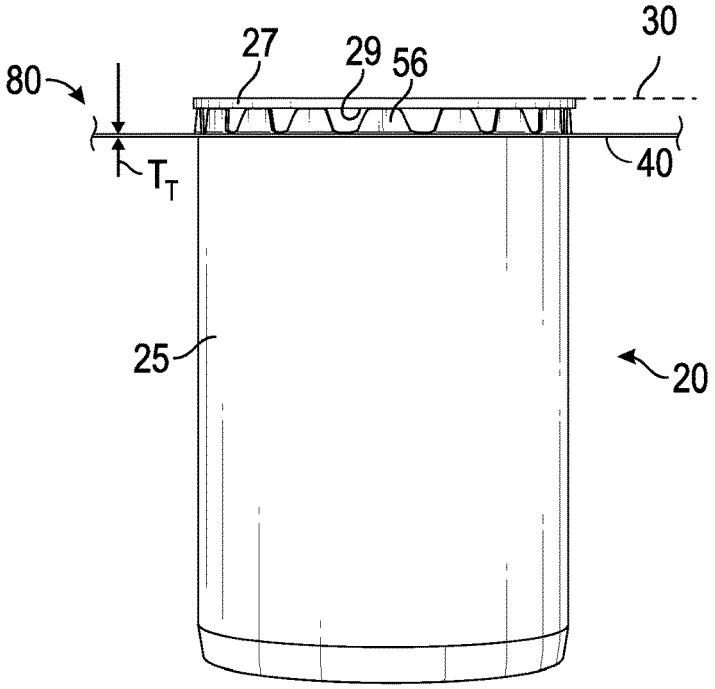
FIG. 5A is a partial side elevational view of a container showing the tabs of the carrier contacting the chime of the container rim.
Figure 5B:
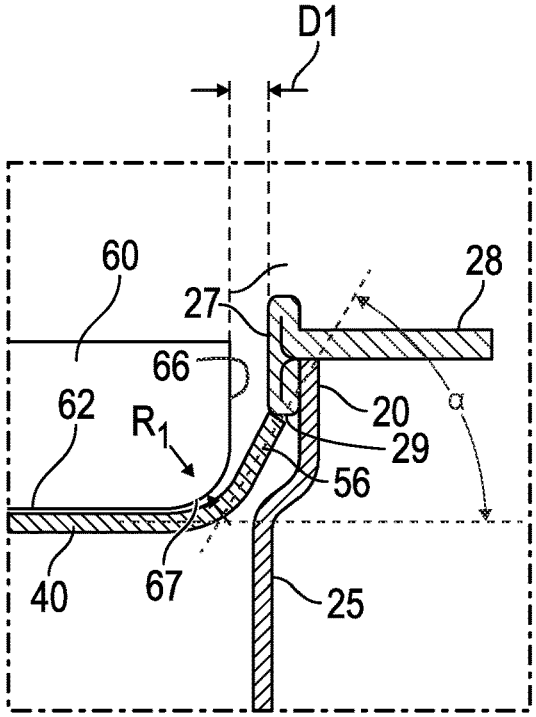
FIG. 5B is an enlarged, partial side elevational view of a platen pressing the carrier down over one of the containers, illustrating a gap between the platen and the container and a radius of a lower corner of the platen.
Figure 14:
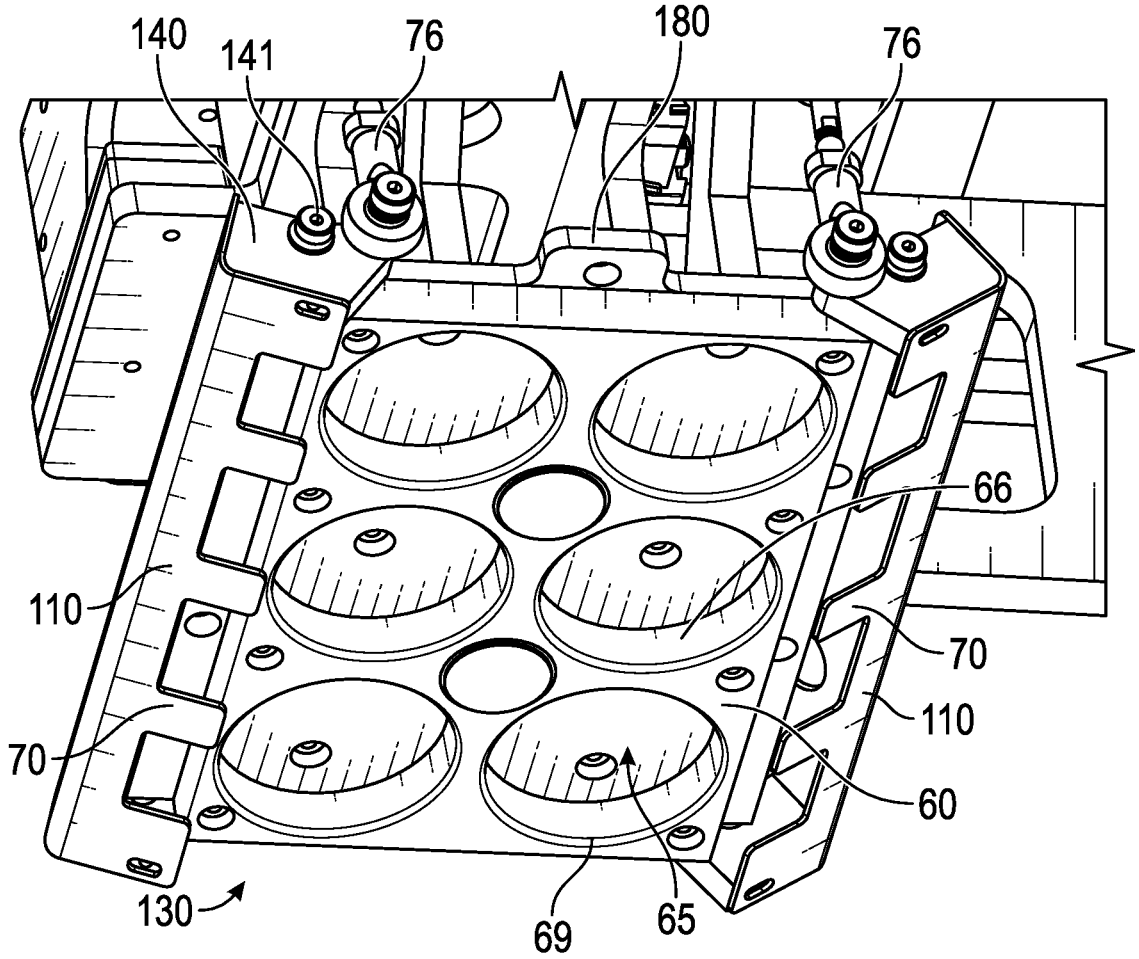
FIG. 14 is a partial bottom perspective view of another alternate embodiment of the semi-automatic embodiment of the invention, illustrating the two carrier plates configured to pivot about a pivot joint between the engaged position and the disengaged position.
Figure 15:
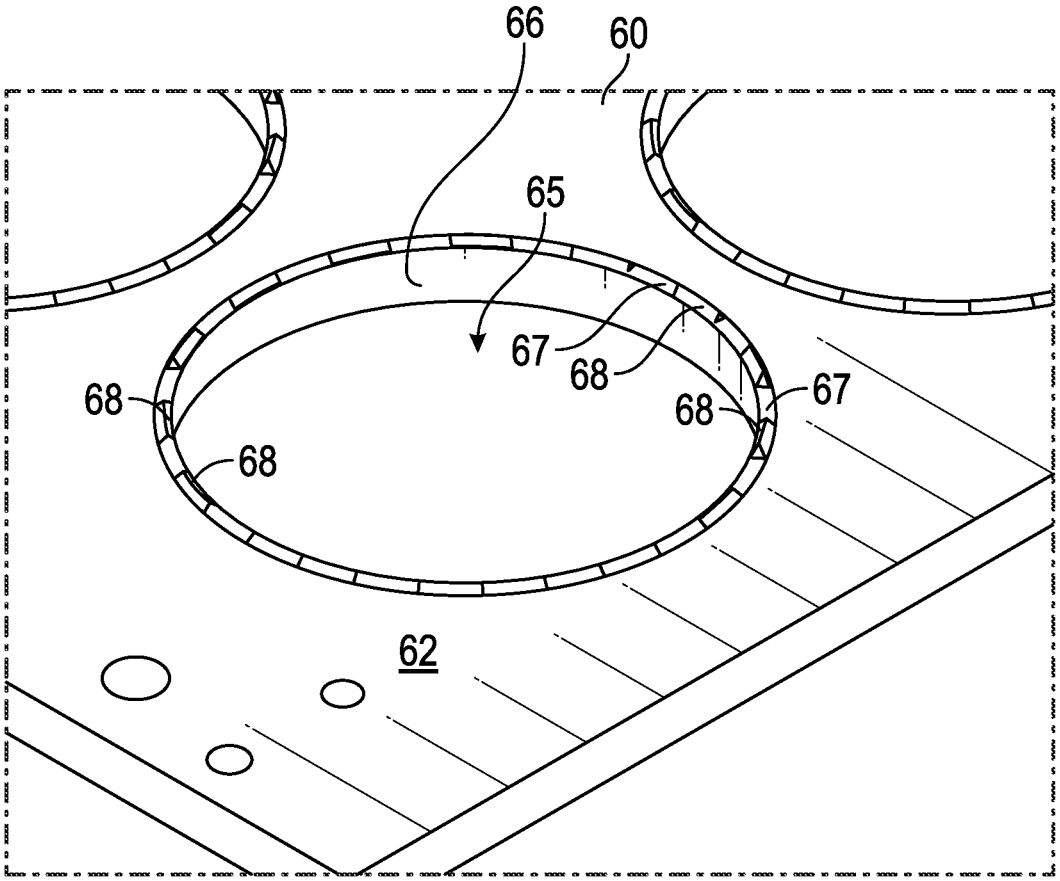
FIG. 15 is an enlarged partial perspective view of one embodiment of the platen, showing a scoring rim at the lower corner of the platen.
Figure 16:
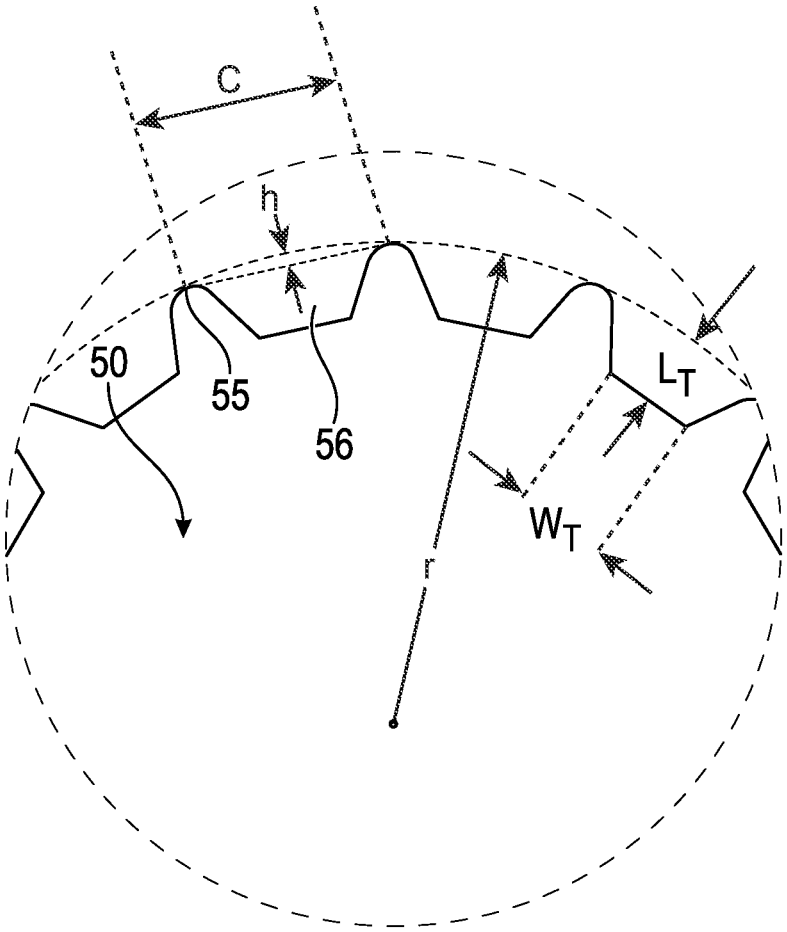
FIG. 16 is a partial top plan view of the carrier, taken along line 16-16 of FIG. 7.

Some embodiments of the system 10 include a manual applicator 90 (FIGS. 6 and 7), while other embodiments include a semi-automatic apparatus 300 (FIGS. 8-14). All embodiments include a platen 60 having apertures 65 for pressing the carrier down uniformly onto the containers 20. A gap $D_1$ is defined between an inside aperture wall 60 of an aperture 65 of the platen 60 and the chime 27 of one of the containers 20 (FIG. 5B). Preferably the gap $D_1$ is between 0.030 inches and 0.050 inches, and ideally at 0.040 inches. A corner 67 between a bottom surface 62 of the platen 60 and the inside aperture wall 66 of each aperture 60 of the platen 60 includes a radius $R_1$, preferably between 0.03125 inches and 0.09375 inches, and ideally at 0.0625 inches, that allows the tabs 56 of each aperture 50 of the carrier 40 to bend uniformly and predictably upward as the platen 60 pushes the carrier 40 downwardly onto the containers 20. In some embodiments the corners 67 of the platen 60 each include a rim 69 with the radius optionally further including scoring portions 68 for urging at least some of the tabs 56 to bend at a score line 57 formed by pressing the carrier 40 down onto the containers 20 (FIG. 15).

As the system 10 is changed over to package containers 20 that are in some ways dissimilar from previous containers 20, certain factors are considered. For example, if a diameter of the container 20 is increased, then the size of the apertures 65 of the platen 60 must increase. Geometric details concerning the size and number of tabs 56 in the aperture 50 are guided by principals that have been developed and employed and are now contained in formulas that have been implement to streamline the design of the apertures 50 and the tabs 56 therein. Guiding principles such as a desired angle α the tab 56 when engaged with the container 20, and the need to minimize a chord offset (h) have been standardized to this end. As such, a number of the tabs 56 in each aperture 50, and a diameter $D_A$ (FIGS. 1, 16) of each aperture 50, can be calculated as follows:

$$(((D+X)/2)-(d/2))/\mathrm{COS}(\alpha)$$

Where:

α=an angle of the tab 56 with respect to the carrier 40 (FIG. 5B), and can range from 30 to 60 degrees above the horizontal carrier 40.

D=a largest diameter that the aperture 50 passes over (typically at the chime 27 of the container 20).

d=a diameter of the neck 26 of the container 20.

The value X added to D in the first term is an amount added to D as a tolerance.

The larger this value, the greater a placement tolerance of the aperture 50 on the container 20. 3 mm is a suggested starting value for X.

To approximate an optimal number of tabs 56 that there should be for the aperture 50, the following estimate can be made:

$$C=2*\sqrt{(h(2r-h))}$$

$$\text{Number of tabs}=180/((C/2)/r)\sin-1$$

Where:

C=a distance of a chord between tabs 56.

h=a distance between the chord and the aperture 50 inside edge 55.

r=a radius of the aperture 50.

Using these calculations and estimate of the geometry of the aperture 50 and tabs 56 can be calculated, cut and tested. It is desirable to minimize the "h" dimension in order to minimize rolling of the carrier 40 as it is installed on the container 20 (which can result in the misapplication of the carrier 40 on the container 20 as in FIG. 2B). However, "h" is never zero, and the minimum practical value of "h" is affected by the manufacturing tooling that is used to form the carrier 40. The strongest aperture 50 has the least number of tabs 56 and the smallest gaps 43 between tabs 56.

One example of these parameters that provides sufficient strength of the carrier 40 on the containers 20 includes a platen aperture 65 diameter of 2.156 inches, with a lower corner 67 radius $R_1$ of 1/16 of an inch (FIG. 5B), a carrier material thickness $T_T$ of 0.028 inches, a diameter of the container 20 at the chime 27 of 2.020 inches, a lower edge 29 thickness of the chime 27 of 0.082 inches, a neck 26 diameter of 2.063 inches, providing a gap $D_1$ of 0.040 inches.

Figure 2A:
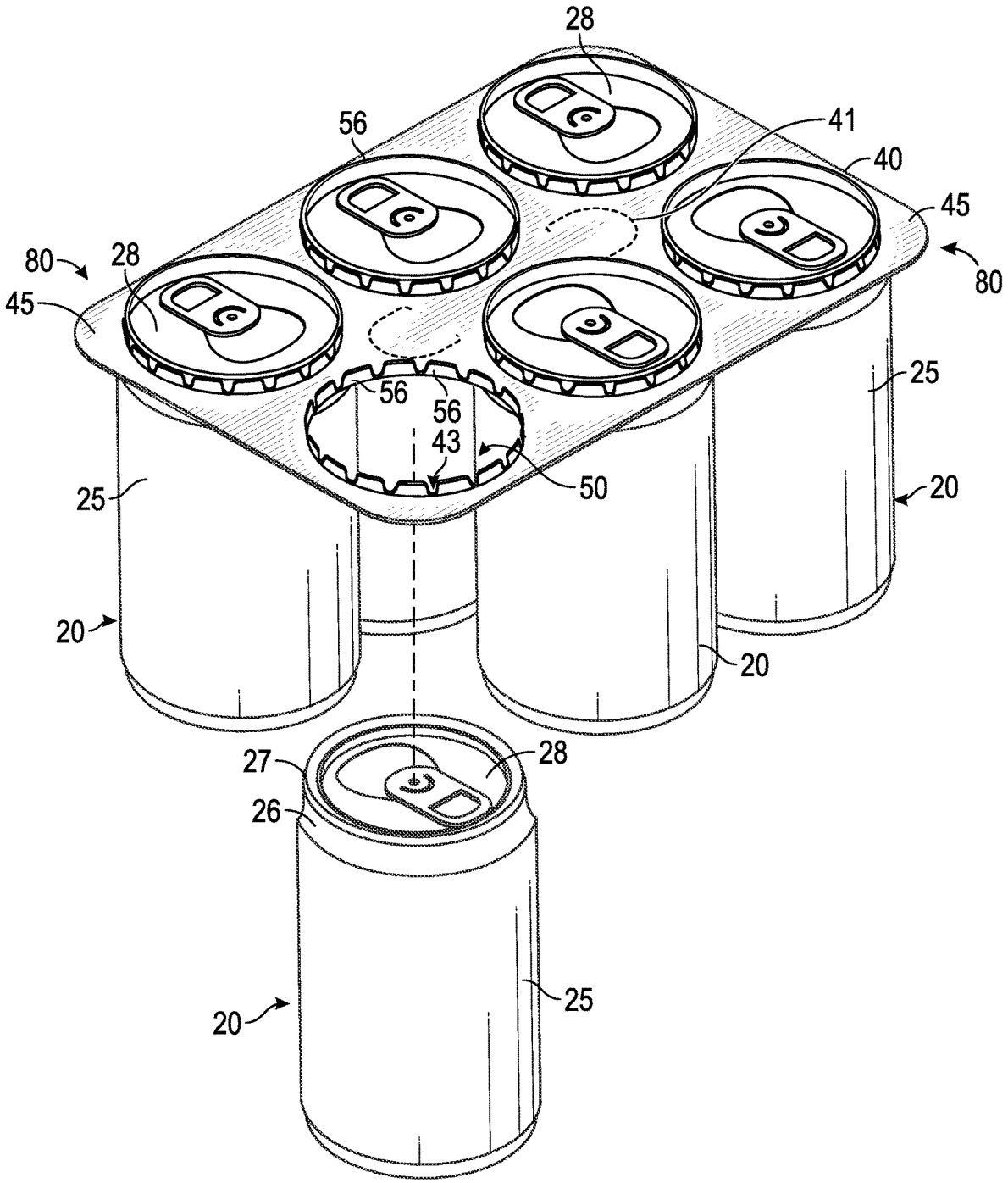
FIG. 2A is a perspective view of a carrier as applied to a plurality of containers.
Figure 2B:
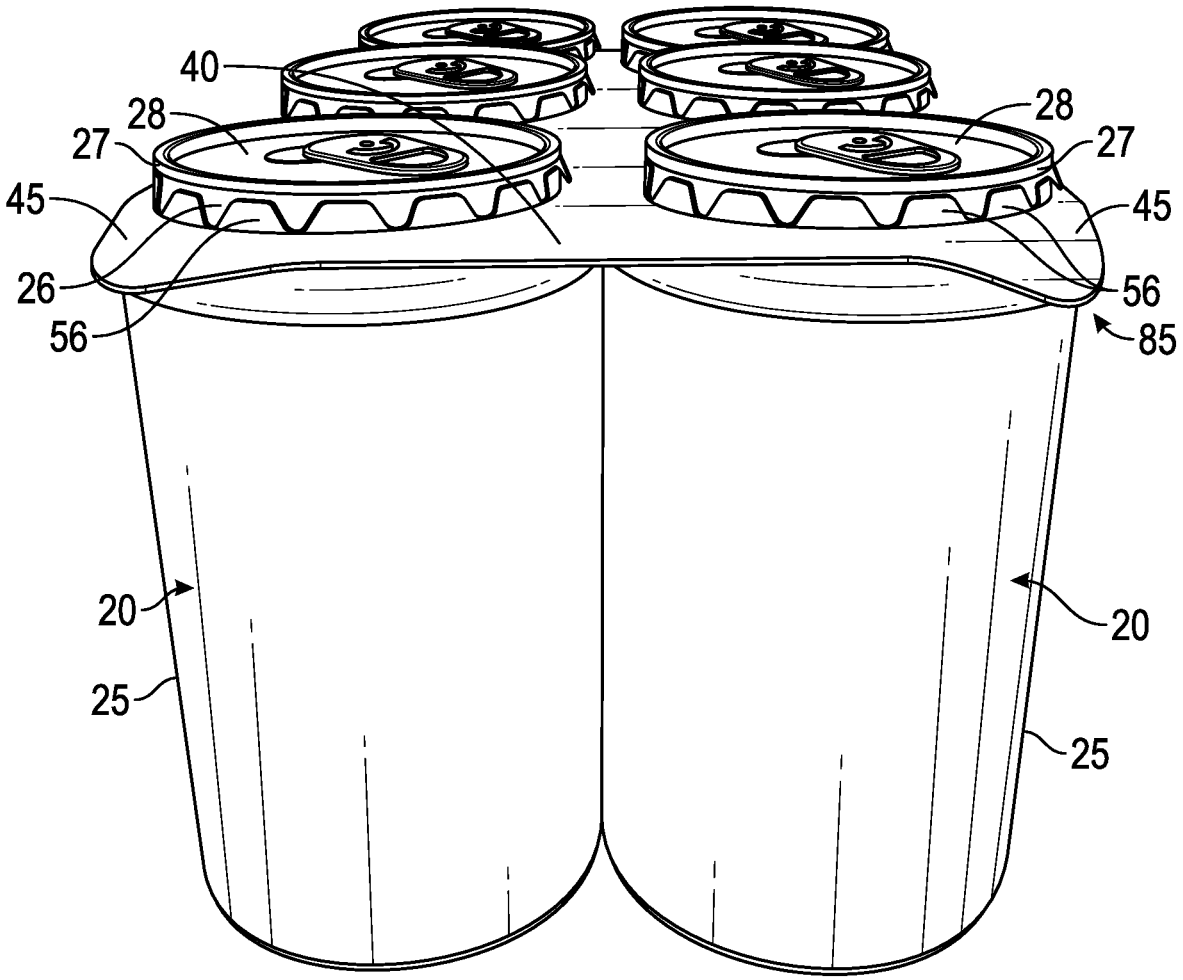
FIG. 2B is an end perspective view of a carrier misapplied to the containers.

FIG. 2B illustrates a mis-application of the carrier 40 onto the containers 20, in that corners 45 of the carrier 40 are bend downwardly in a non-flat configuration 85, rendering some of the tabs 50 separated from the lower edge 29 of the chime 27 of some of the containers 20. Such downward bending of the corners 45 can occur when the corners 45 are not supported in the flat configuration 80 during application of the carrier 40 to the containers 20. In the system 10, importantly, the carrier 40 must remain in a flat configuration 80 (FIGS. 2A and 5A) when applied to the containers 20. Accordingly, each embodiment of the system 10 includes a carrier support 70 configured for maintaining the carrier 40 in the flat configuration 80 as the platen 60 presses the carrier 40 onto the containers 20 substantially simultaneously, with only the tabs 56 of the carrier 40 bending out of the flat configuration 80 as the tabs 56 are forced by the corner 67 of the platen 60 and the chime 27 of the containers to bend uniformly upward until the tabs 56 clear the chime 27 of the containers 20 to contact both the lower edge 29 of the chime 27 and the neck 26 of the container 20 (FIGS. 4A-5B).

In use, with the carrier 40 supported with the carrier support 70 in the flat configuration 80, the platen 60 presses the carrier 40 onto the containers 20 uniformly and simultaneously. The tabs 56 of the carrier 40 deform upwardly substantially simultaneously to pass the chimes 27 of the containers 20, each tab 56 abutting the lower edge 29 of the chime 27 of one of the containers 20 to hold the containers 20 together with the carrier 20. The platen 60 is thereafter withdrawn from the carrier 40 and the containers 20 to release the carrier 40 and the containers 20.

Figure 6:
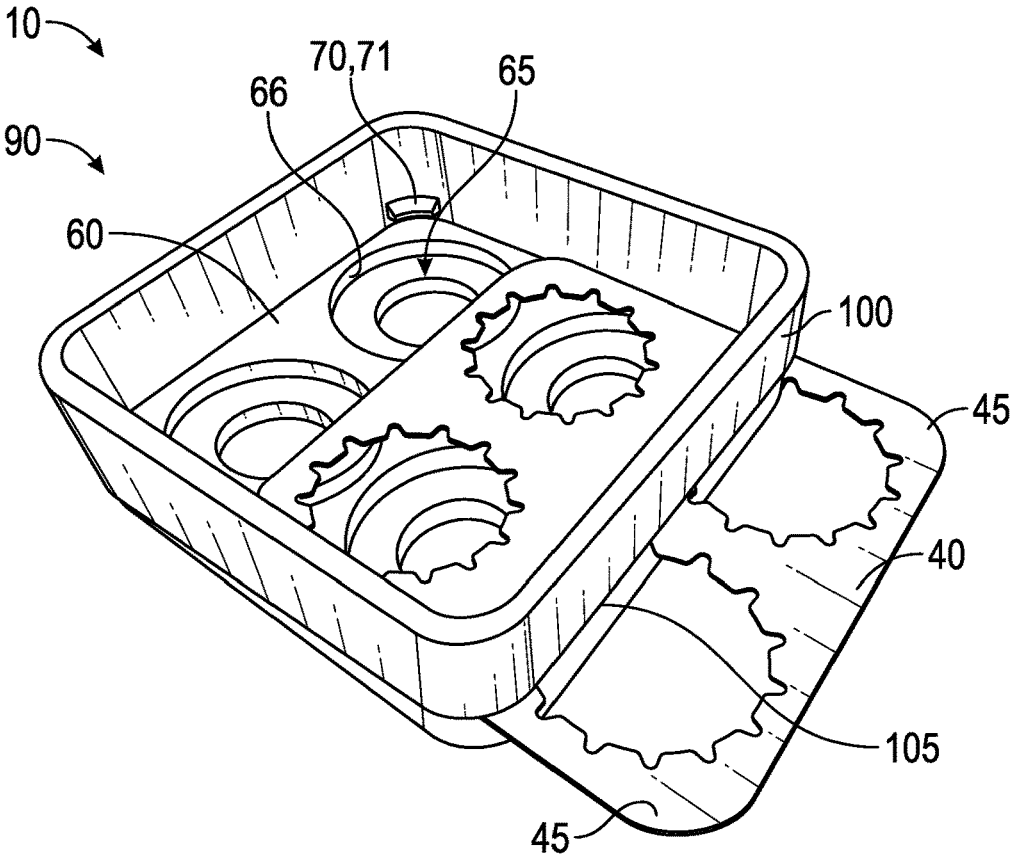
FIG. 6 is a bottom perspective view of a manual embodiment of the invention, illustrating the platen and a carrier support integrally formed to receive the carrier through a slot in a skirt thereof.
Figure 7:
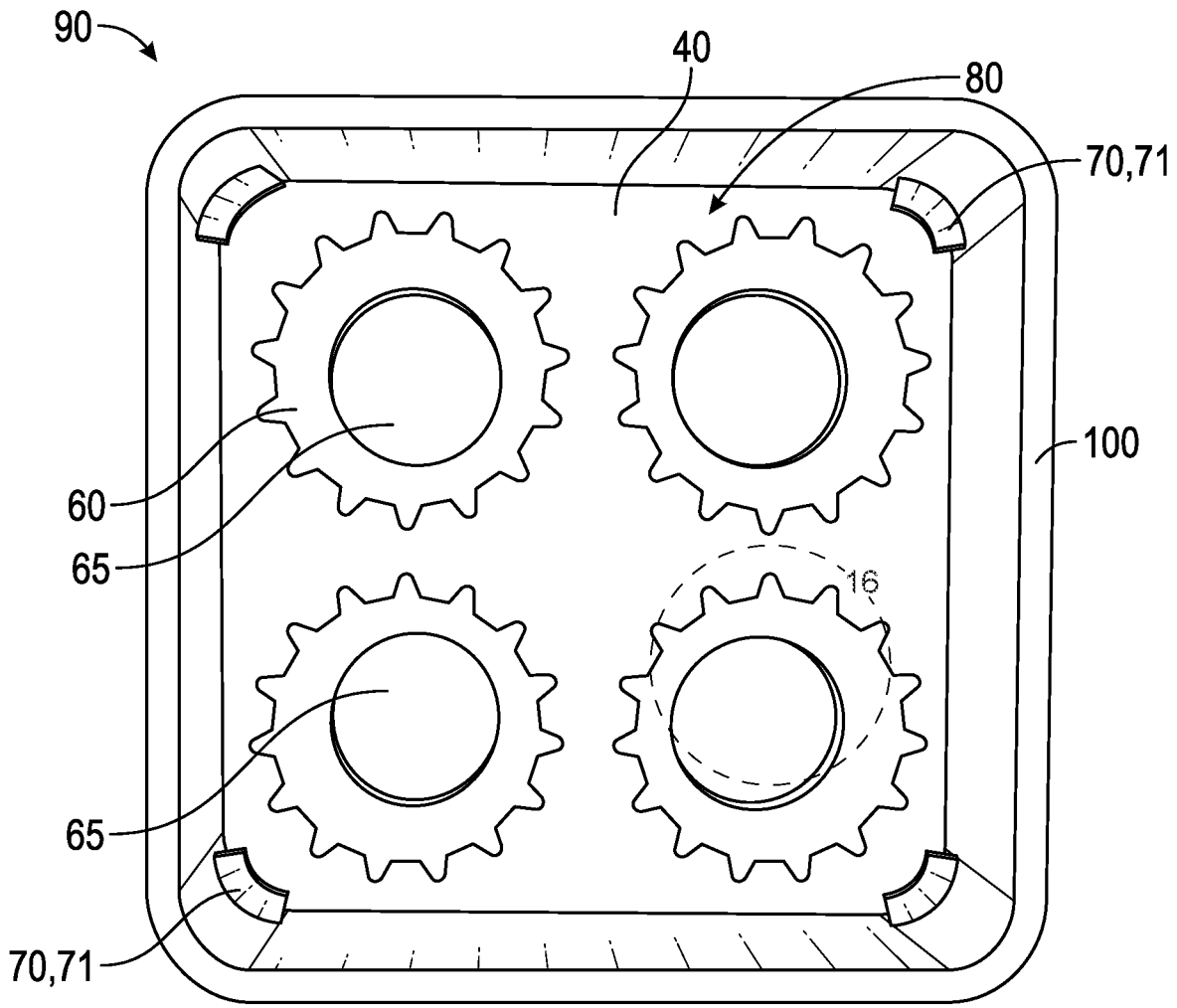
FIG. 7 is a bottom plan view of the embodiment of FIG. 6, illustrating the carrier fully engaged with the carrier support and ready to engage four of the containers.
Figure 8:
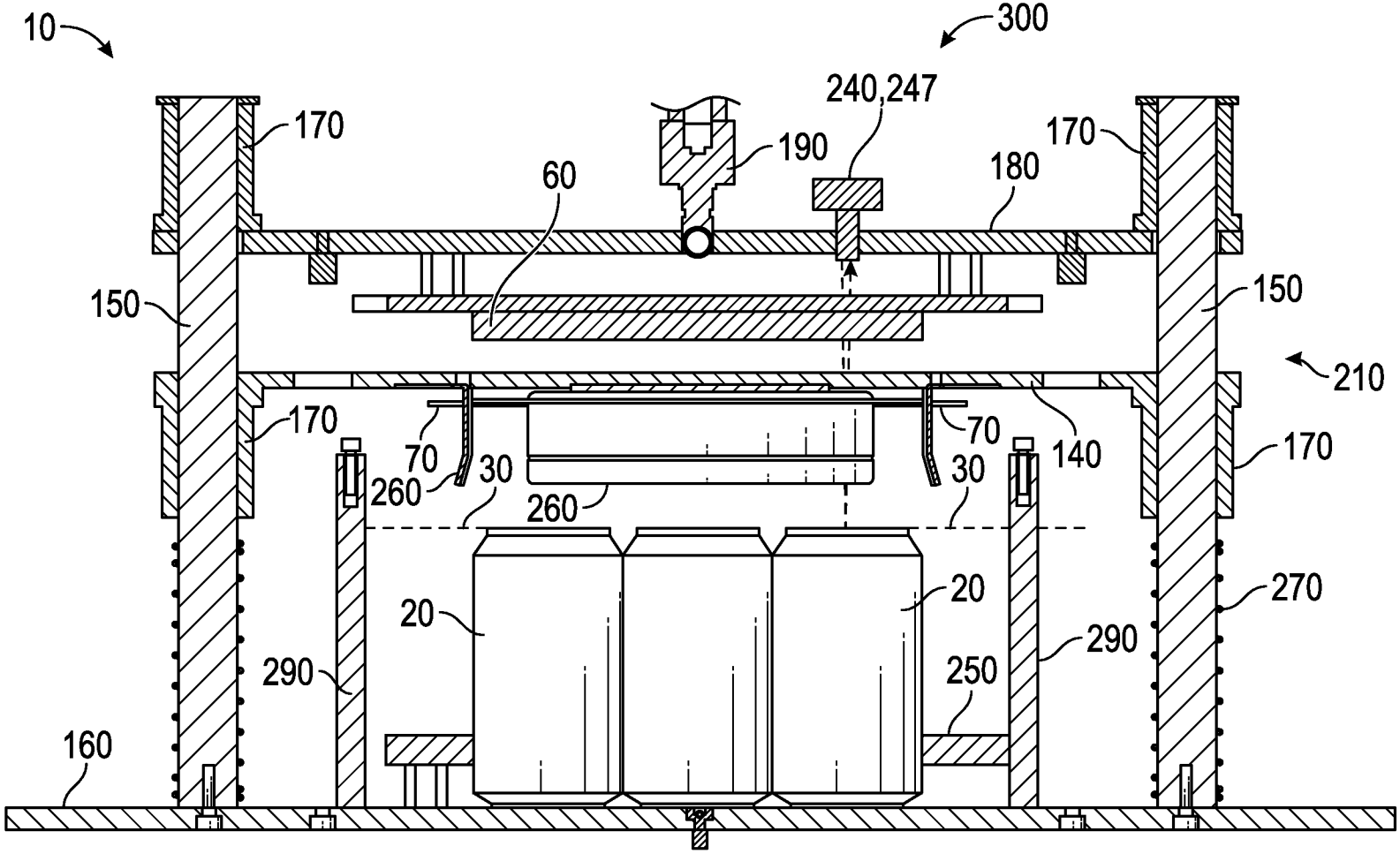
FIG. 8 is a partial front elevational view of a semi-automatic embodiment of the invention, illustrating guides for slidably supporting the carrier support and the platen above the containers.
Figure 9A:
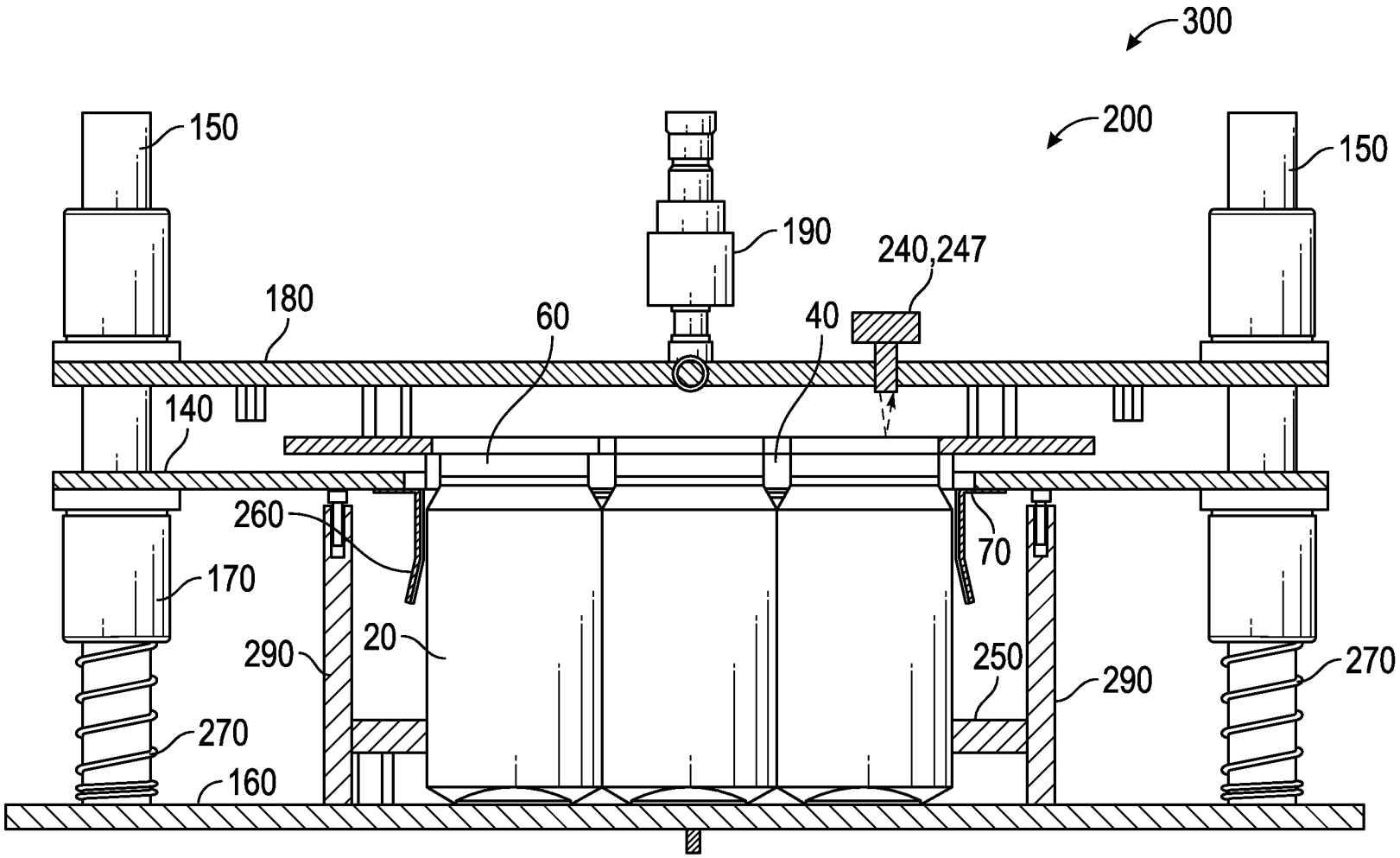
FIG. 9A is a partial front elevational view of the embodiment of FIG. 8, illustrated with the platen and carrier support in a lowered position to mount the carrier to the containers.
Figure 9B:
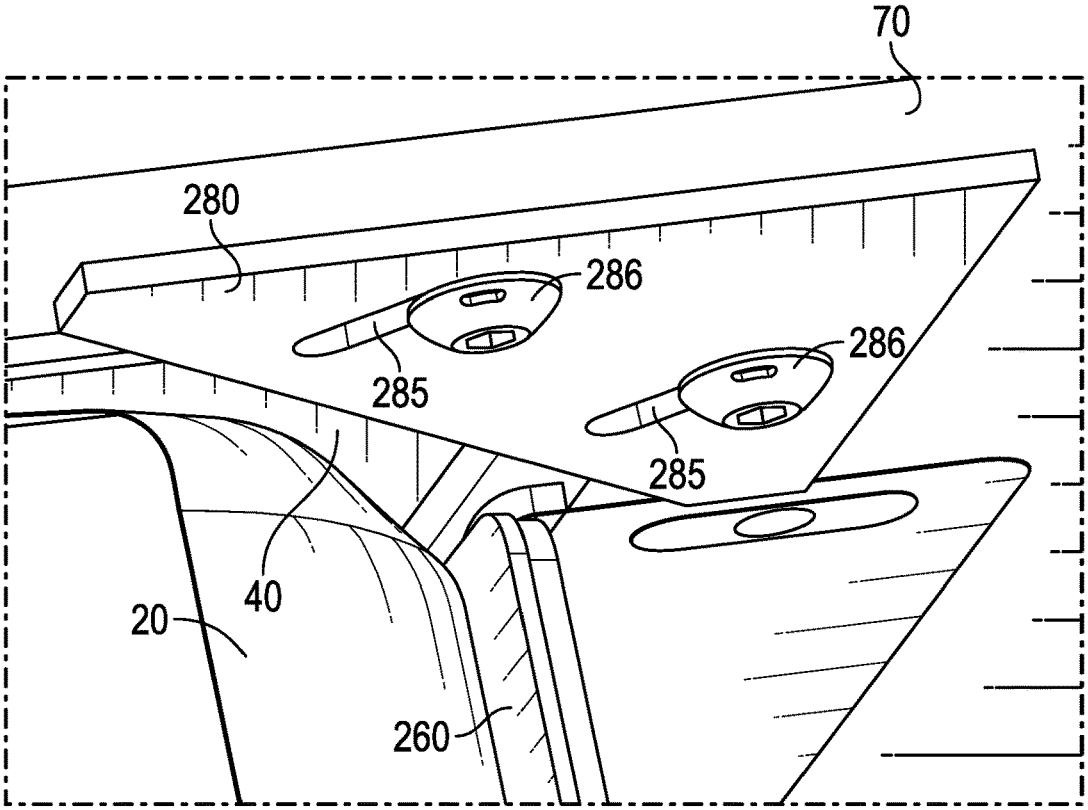
FIG. 9B is an enlarged partial bottom perspective view of a corner support of the carrier support that supports a corner of the carrier, the corner support being selectively positionable.

In embodiments having the manual applicator 90, preferably the platen 60 is integrally formed with the carrier support 70 (FIGS. 6 and 7). Such a manual applicator 90 is preferably 3D printed or injection molded with a rigid plastic material, although such an applicator 90 may also be machined from wood, metal, or other rigid material. In such an embodiment, a skirt 100 may be included that has a slot 105 configured for receiving the carrier 40 therethrough to the carrier support 70, which is preferably four corner supports 71 that help maintain the carrier 40, and particularly corners 45 of the carrier 40, in the flat configuration 80. Once the carrier 40 is engaged with the containers 20, the manual applicator 90 is pulled upward away from the carrier 40 and containers 20, whereby the corners 45 of the carrier 40 are forced to bend upward slightly until the corners 45 are able to clear the four corner supports 71, releasing the carrier 40 and the containers 20.

In embodiments having the semi-automatic apparatus 300 (FIGS. 8-14), the carrier support 70 includes at least one carrier retainer plate 110 movable between an engaged position 120 wherein the at least one carrier retainer plate 110 engages and supports the carrier 40, and a disengaged position 130 wherein the at least one carrier retainer plate 110 is retracted away from and disengages from the carrier 40. Each carrier retainer plate 110 is fixed with a carrier mount 140. In some embodiments, each carrier retainer plate 110 is slidably fixed with the carrier mount 140 (FIGS. 11-13B). In other embodiments, each carrier retainer plate 110 is rotatably fixed with the carrier mount 140 at a pivot joint 141 (FIG. 14). In embodiments wherein the at least one carrier retainer plate 110 is movable with respect to the carrier mount 140, preferably pneumatic or electric actuators 75 are included to move the at least one carrier retainer plate 110, through mechanical linkages 76, between the engaged position 120 and the disengaged position 130. Preferably each carrier retainer plate 110 includes adjustable corner supports 280 (FIG. 9B) configured to optimally support the corners 45 of the carrier 40. Such adjustable corner supports 280 preferably include a slot 285 through which a mechanical fastener 286 traverses to mount the adjustable corner support 280 to the carrier retainer plate 110.

In such semi-automatic embodiments, preferably at least a pair of guides 150 are included, fixed orthogonally with a base 160. Such guides 150 may be guide rods 151, guide tracks (not shown), or the like, and are used to guide the platen 60 and carrier support 70 vertically down onto the containers 20. Accordingly, the carrier mount 140 has at least a pair of slide mechanism 170 each for engaging one of the guides 150. Such a slide mechanism 170 may be an apertures 172 through the carrier mount 140, and may further include a linear bearing 171 for precisely guiding the carrier mount 140 straight down towards the containers 20 and the base 160. Similarly, with the platen 60 fixed with a platen mounting plate 180, the platen mounting plate 180 also includes at least a pair of the slide mechanism 170, each for engaging one of the guides 150 above the carrier mounting plate 140. The platen 60 is thereby slidably fixed with the guides 150 above the carrier retainer plates 110 and the carrier mount 140.

To facilitate the proper position of the carrier 40, a slot 145 (FIG. 13B) may be included at a front side of the carrier mount 140 so that the operator can insert the carrier 40 into the slot 145, the slot 145 terminating above the carrier support 70. Once inserted into the slot 145, the carrier 40 is seated properly onto the carrier support 70 by, for example, dropping down onto the carrier support 70 that just fits the dimensions of the carrier 40.

As such, with the carrier retainer plates 110 in the engaged position 120 and engaged with the carrier 40, and with the containers 20 each supported on the base 160 and aligned to receive the carrier 140, the platen mounting plate 180 is moved downward, guided by the guides 150, until the platen 60 engages the carrier 40. The platen mounting plate 180 and the carrier mount 140 are then moved downwardly together until the tabs 56 of the apertures 50 of the carrier 40 contact the chimes 27 of the containers 20. Thereafter, the tabs 56 of the apertures 50 of the carrier 40 are bent upward under downward pressure from the platen 60 until each tab 56 engages the neck 26 and the lower edge 29 of the chime 27 of one of the containers 20.

At this point the carrier retainer plates 110 are retracted to release the carrier 40 from the carrier support 70. The carrier mount 140 and platen mounting plate 180 are thereafter raised to clear the carrier 40 and the containers 20, such that the carrier 40 and the containers 20, now packaged together, can be removed. In some embodiments, the guides 150 include platen springs 270 (FIGS. 8, 9A and 10A) or other urging means to automatically lift the carrier mount 140 above the containers 20 enough so that the containers 20 and carrier 40 may be removed from the apparatus 300.

Figure 10B:
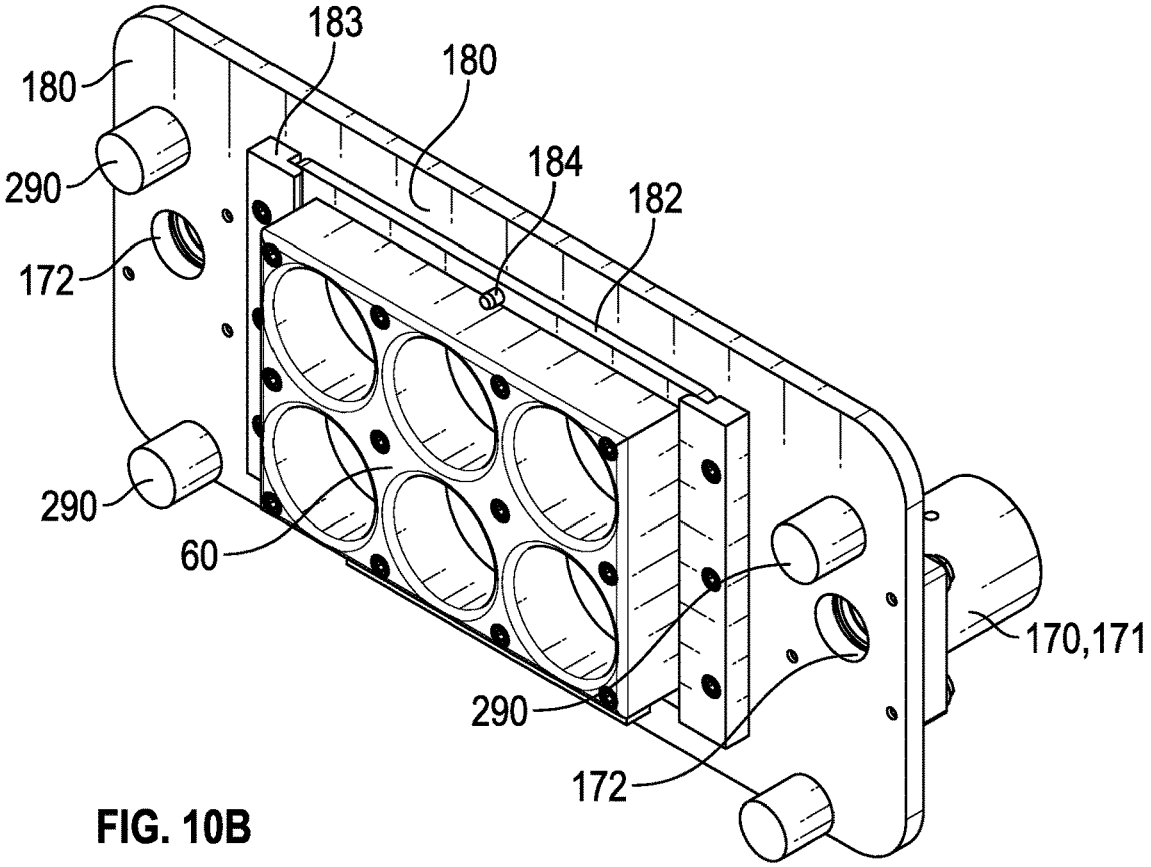
FIG. 10B is a partial bottom perspective view of an alternate embodiment, wherein the platen is mounted to a quick change plate adapted for engaging a releasable platen mount of the platen mount plate.

In some embodiments the platen mounting plate 180 includes a releasable platen mount 183 for engaging a quick change plate 182 of the platen 60 (FIG. 10B). A locking pin 184 locks the platen 60 and the quick change plate 182 to the platen mounting plate 180. As such, platens 60 having varying sizes and number of apertures 65 can be quickly interchanged in system 10.

In some embodiments the semi-automatic apparatus 300 includes at least one upper container guide 260 projecting downwardly from the carrier mount 140. Such an upper container guide 260 is adapted to contact at least one of the containers 20 as the carrier 40 is lowered towards the containers 20 so as to properly position the containers 20 with respect to the carrier 40. Similarly, at least one lower container guide 250 (FIG. 10A) may be include for an operator (not shown) to properly position the containers 20 initially on the base 160.

The semi-automatic apparatus 300 preferably includes at least one linear actuator 190 fixed with the platen mounting plate 180 and adapted to raise and lower the platen mounting plate 180 and platen 60 between a raised position 210 wherein the platen 60 and carrier support 70 clear the containers 20, and a lowered position 200 wherein the carrier 40 and platen 60 engaged the containers 20.

A controller 220 may be electrically connected with one or two switches 230 that, when actuated, cause the controller 220 to lower the platen mount 140 from the raised position 210 towards the containers 20. Vertically adjustable mechanical stops 290 (FIGS. 8 and 9A) may be included to prevent downward travel of the platen 60 and carrier support 70 below the lowered position 200.

Alternately, the controller 220 is electrically connected with a proximity sensor 240 adapted to detect when the chime 27 of one of the containers 20 reaches a predetermined position with respect to the platen 60, at which point the controller 220 raises the platen mount 140 to the raised position 210. Such a proximity sensor 240 may be, for example, a photoelectric eye (not shown) that receives a beam of light from an emitter (not shown), such that the beam of light is broken by the chime 27 of one of the containers 20 when the platen 60 reaches the lowered position 200. Alternately, the proximity sensor 240 is a contact switch (not shown) that is closed when contacting the lid 28 of one of the containers 20. Preferably, however, the proximity sensor 240 is a laser distance sensor 247 (FIG. 9A) mounted with the platen 60 or the platen mounting plate 180 and adapted to return a distance range between the laser distance sensor 247 and the lid 28 of one of the containers 20. As such the controller 220 is programed to return to the raised position 210 upon reaching a user-set lowered position 200 that is based on a height of the containers 20.

Preferably the controller is electrically connected to a safety light curtain safety apparatus 310 (FIG. 10A) fixed between the platen mounting plate 180 and the operator (not shown), as is known in the art, to keep the operator from inadvertent injury. Other safety features that are known in the art or become known in the art can also be utilized with the semi-automatic apparatus 300 as appropriate.

Because containers 20 of various heights can be processed through the semi-automatic apparatus 300, it is necessary to control the vertical travel of the platen 60 as the platen 60 is moved by linear actuator 190 (usually a pneumatic cylinder, although other types of linear actuators 190 may be utilized as well). For example, changing processing from 12 oz. beverage containers 20 with an approximate overall height of 120.65 mm to processing 16 oz. beverage containers 20 with an approximate overall height of 158.75 mm, due to the height differential of the containers 20, the platen 60 must be able to resent the height of the lowered position 200 at various distances while still allowing vertical clearance for container ingress and egress into the apparatus 300 at the raised position 210.

The laser distance sensor 247 (FIG. 9A) measures the position of the platen 60 along its travel range as the platen 60 moves from the raised position 210 to its operator-set lowered position 200, negating the need for the mechanical stops 290 in such an embodiment. The laser distance sensor 247 can be applied to the platen 60 or the platen mounting plate 180 in such a way as to measure the absolute vertical height of the laser distance sensor 247 from the base 60. As such, the operator programs the controller 220 for the proper lowered position 220 for each type of container 20 to be packaged. A 12 oz container 20 may have a different lowered position 220 than does a 16 ox container 20, for example. Once these lowered positions 220 are set in a memory of the controller 220, efficient packaging can begin with any number of different sized containers 20.

Alternately, laser distance sensor 247 can be applied to the platen 60 or the platen mounting plate 180 in such a way as to measure the absolute vertical height of the laser distance sensor 247 from one of the containers 20. In such an embodiment, a height of the platen 60 and a distance from the lid 28 to the lower edge 29 of the chime 27 are used to determine a proper setting of the lowered position 200, such lowered position 200 being relative and not related to the absolute height of the containers 20. Either way, such a laser distance sensor 247 allows the controller to accurately stop downward pressure of the platen 60 onto the carrier 40 at near the optimal height for proper placement of the carrier 40 onto the containers 20.

Determining the proper vertical position of the lowered position 200 for the platen 60 is critical to proper application of the carrier 40 to the containers 20, and should be no less accurate than +/−1 mm. For example, if the lowered position 200 is set too high the carrier 40 will not be fully applied to under the chime 27 of the containers 20, and packaging failure can occur. If the lowered position 200 is set too low and the platen 60 travels past the proper lowered position 200, the carrier 40 will be "over-applied," possibly resulting in tearing, deformation or other structural damage to the carrier 40, damage the containers 20 themselves, possibly to the point of crushing or breaking thereof, which can cause slowdown to, or stoppage of, a production line.

Utilizing either of these embodiments, containers 20 of dissimilar heights can be processed through the apparatus 300 relatively quickly and without additional tooling or hardware during changeover by the operator. This also allows for quick, repeatable changeovers for varied height containers 20 by skilled or unskilled labor and increases efficiency in production line processing.

Regarding safety of the operator of the semi-automatic apparatus 300, since the operator is required to put his hands into the apparatus 300 to load the carriers 40 and the containers 20, it is imperative that the apparatus 300 be inoperable while the operator's hands and arms are inside of the apparatus 300.

Figure 10A:
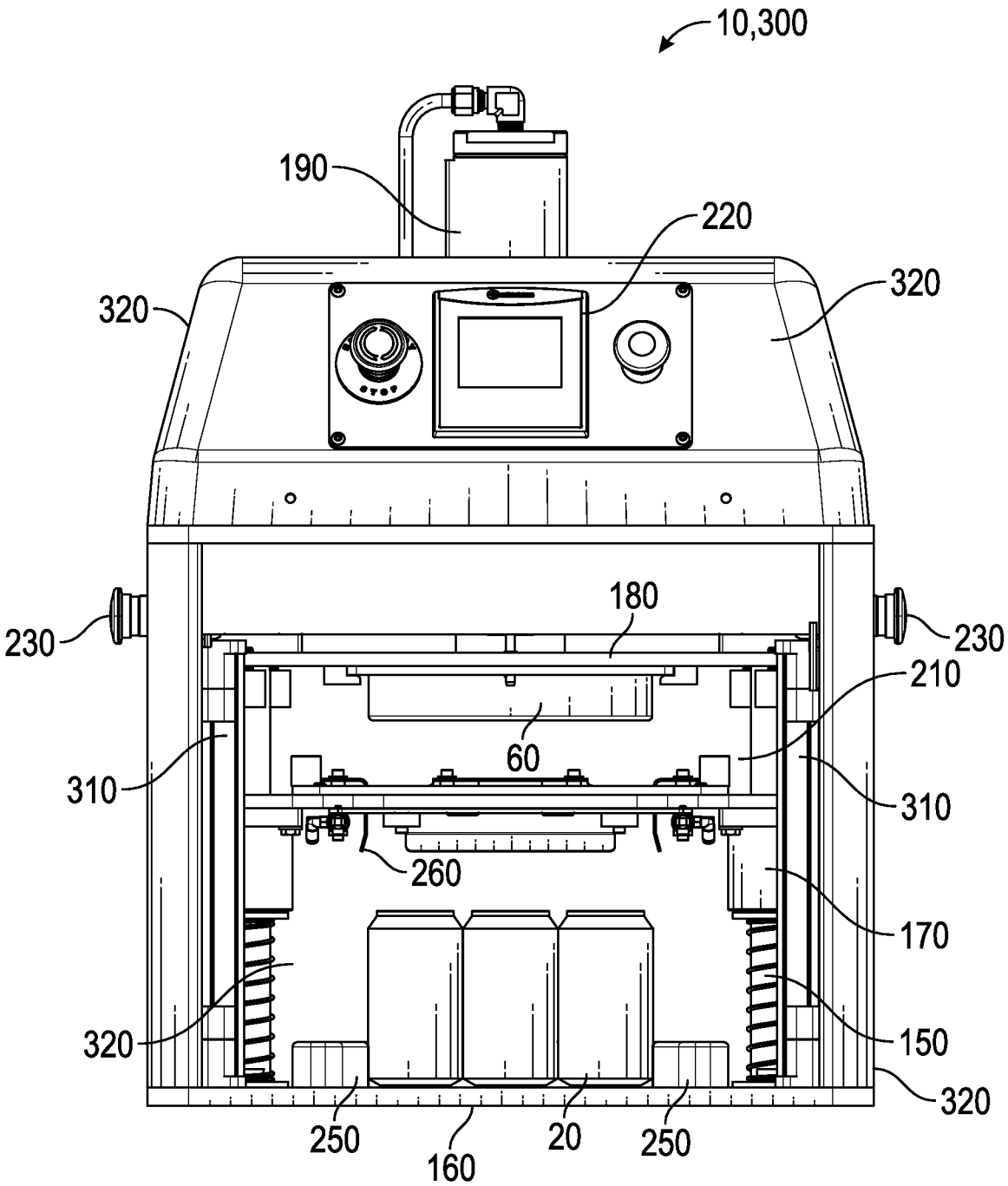
FIG. 10A is a front elevational view of another semi-automatic embodiment, illustrating a controller and switches for an operator to move a linear actuator.
Figure 11:
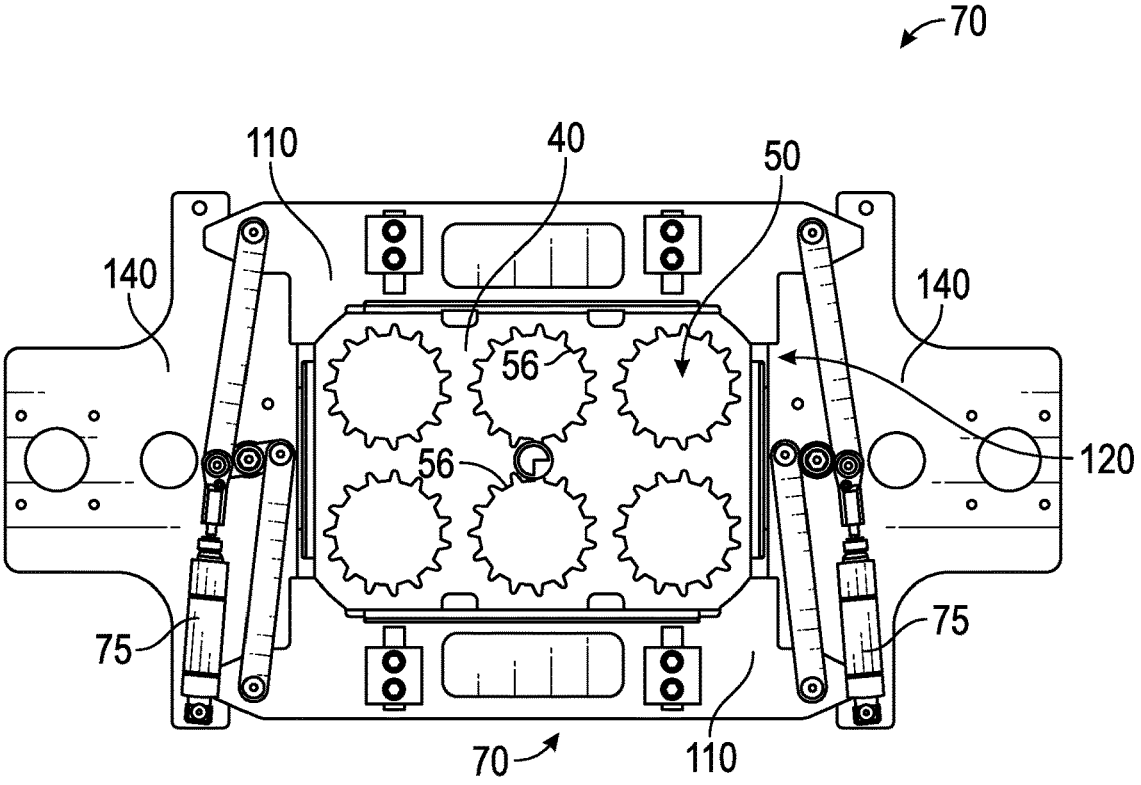
FIG. 11 is a partial bottom plan view of an alternate embodiment of the carrier support, wherein actuators have positioned two carrier retainer plates in an engaged position supporting the carrier over the containers.
Figure 12:
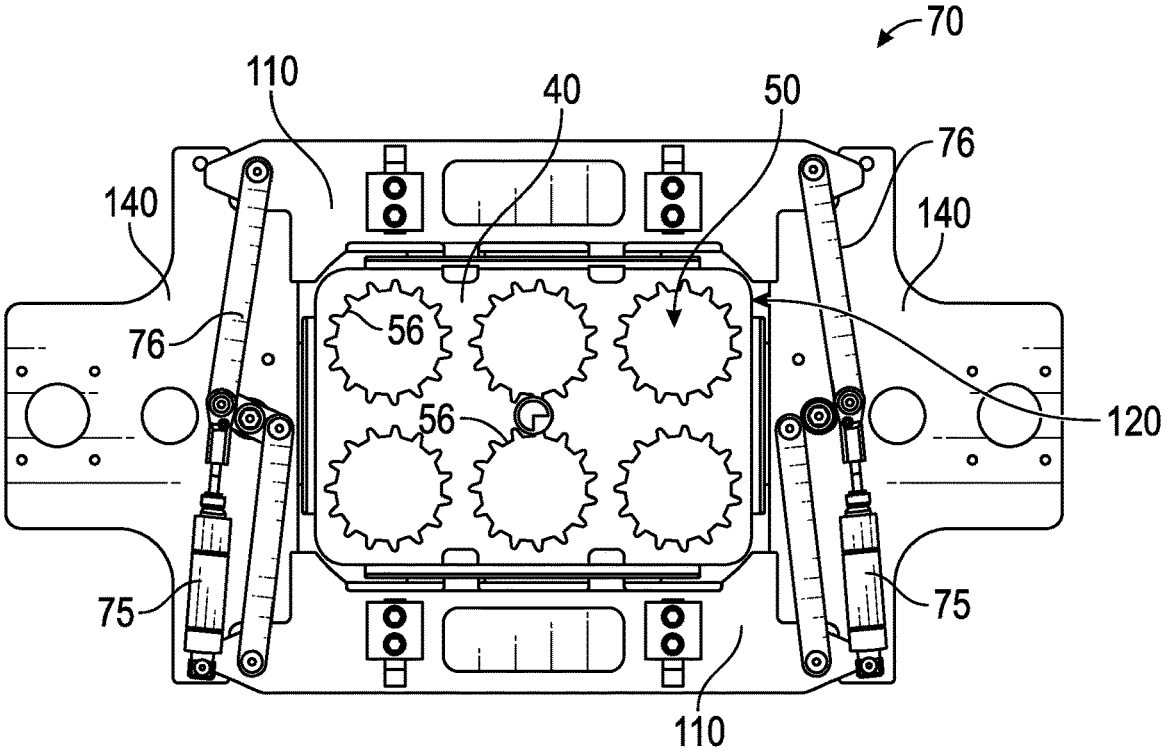
FIG. 12 is a partial bottom plan view of the embodiment of FIG. 11, illustrated in a disengaged position releasing the carrier and containers.
Figure 13A:
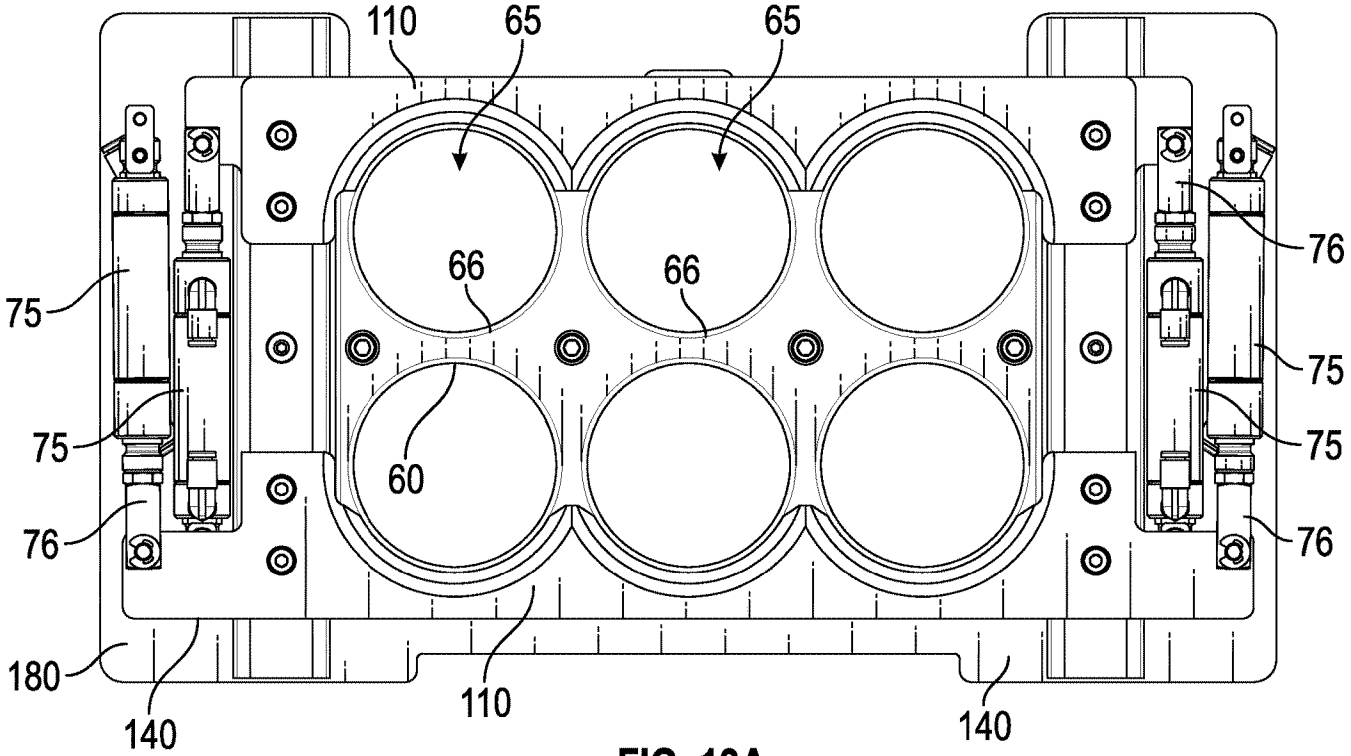
FIG. 13A is a bottom plan view of an alternate embodiment of the carrier support, illustrating actuators configured to move two carrier retainer plates between the engaged position and the disengaged position.
Figure 13B:
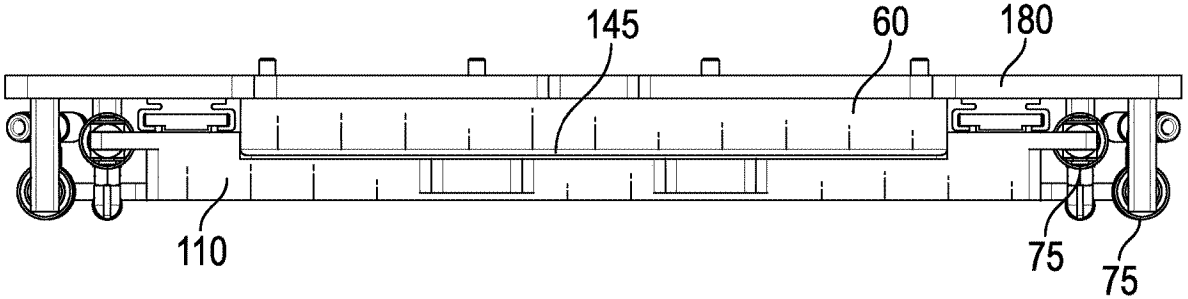
FIG. 13B is a front elevational view of the embodiment of FIG. 13A, illustrating a slot for receiving the carrier from an operator thereof.

In preferred embodiments, two of the switches 230, wired in series, are required to be depressed to start the linear actuator 190 moving the platen 60 from its raised position 210 to its lowered position 200 (FIG. 10A). Accordingly, with both of the operator's hands depressing the switches 230, his hands cannot be dangerously close to the moving platen 60 and other moving components.

Further, the light curtain 310 creates several invisible beams of light across an opening of the apparatus 300, which must be traversed by the operator's hands when loading the apparatus 300 with the containers 20 and the carriers 40. If any of the beams of light are interrupted, a safety circuit is opened and the linear actuator 190 deactivates. Once the operator has removed his hands and arms from the opening 300 and is ready to cycle the apparatus 300, the operator simultaneously depresses the two switches 230 to activate the linear actuator 190 again. The apparatus 300 operates normally as long as the light curtain 310 remains unbroken with the safety circuit "closed."

A foot pedal auxiliary actuator device (not shown) may also be utilized for the actuation of the linear actuator 190, in lieu of the two switches 230, if desired for hands-free operation, provided the light curtain 310 is included. This combination of safety components allows for SIL level 2 safety certification.

Protective shrouding and panels 320 (FIG. 10A) have been added to the structure of the apparatus 300 in order to limit the ability of hands, fingers, particles or contaminants to enter the apparatus 300. In other embodiments safety mechanisms may include interlocked guard doors (not shown) that include two hinged doors attached to the apparatus 300 with an electrical safety interlock wired so that the apparatus 300 cannot operate until the guard doors are closed. When the doors are open the electric safety circuit is open and the apparatus 300 is inoperable.

While a particular form of the invention has been illustrated and described, it will be apparent that various modifications can be made without departing from the spirit and scope of the invention. For example, the specific arrangement of the various components of the semi-automatic apparatus 300 may be shifted around somewhat, and varying types of guides 150 or proximity sensors 240 may be utilized as is or becomes known in the art. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A system for packaging two or more containers of the type having a body, a neck, and a lid with a chime, the chimes of the containers all aligned in a horizontal plane, the containers packaged together with a carrier of the type having two or more apertures each for receiving the chime and neck of one of the containers, each aperture having a plurality of tabs formed at an inside edge thereof, each tab configured for bending upward when contacting the chime of one of the containers, each tab having a length and a thickness, the system comprising:

a platen having apertures for pressing the carrier down uniformly onto the containers, each aperture having a gap between an inside aperture wall and the chime of one of the containers;

a carrier support configured for maintaining the carrier in a flat configuration, the carrier support configured to contact at least a portion of a bottom side of the carrier;

whereby with the carrier supported with the carrier support, the platen presses the carrier onto the containers uniformly, the tabs of the carrier deforming upwardly substantially simultaneously to pass the chimes of the containers, each tab abutting a lower edge of the chime of one of the containers to hold the containers together with the carrier, the platen thereafter being withdrawn from the carrier and the containers to release the carrier and the containers, wherein a corner between a bottom surface of the platen and the inside aperture wall of each aperture of the platen is a rounded corner.

2. The system of claim 1 wherein the corner between the bottom surface of the platen and the inside aperture wall of each aperture of the platen includes a radius between 0.03125 inches and 0.09375 inches.

3. The system of claim 1 wherein the gap between the inside aperture wall of each aperture of the platen and the chime of one of the containers engaged with the aperture of the platen is between 0.030 inches and 0.050 inches.

4. The system of claim 1 wherein a manual applicator includes the carrier support integrally formed with the platen.

5. The system of claim 4 wherein the manual applicator includes a skirt having a slot therein for receiving the carrier therethrough to engage the carrier support.

6. The system of claim 1 wherein the carrier support includes at least one carrier retainer plate movable between an engaged position wherein the at least one carrier retainer plate engages and supports the carrier, and a disengaged position wherein the at least one carrier retainer plate is retracted away from and disengages from the carrier, each carrier retainer plate fixed with a carrier mount.

7. The system of claim 6 further including at least a pair of guides orthogonally fixed with a base, the carrier mount having at least a pair of slide mechanisms each engaging one of the guides, the platen fixed with a platen mounting plate that also includes at least a pair of the slide mechanisms each engaging one of the guides, the platen slidably fixed with the guides above the carrier retainer plates and the carrier mount;

whereby with the carrier retainer plates in the engaged position and engaged with the carrier, and with the containers each supported on the base and aligned to receive the carrier, the platen mounting plate is moved downward, guided by the guides, until the platen engages the carrier, the platen mounting plate and the carrier mount then moved downwardly together until the tabs of the apertures of the carrier contact the chimes of the containers, the tabs of the apertures of the carrier being bent upward under downward pressure from the platen until each tab engages the neck and the lower edge of the chime of one of the containers, the carrier retainer plates then being retracted to release the carrier from the carrier support, the carrier mount and platen mounting plate thereafter being raised to clear the carrier and the containers such that the carrier and the containers can be removed from the semi-automatic apparatus.

8. The system of claim 7 further including at least one upper container guide projecting downwardly from the carrier mount and adapted to contact at least one of the containers as the carrier is lowered towards the containers to properly position the containers with respect to the carrier.

9. The system of claim 7 further including at least one linear actuator fixed with the platen mounting plate and adapted to raise and lower the platen mounting plate and platen between a raised position wherein the platen and carrier support clear the containers, and a lowered position wherein the carrier and platen engage the containers.

10. The system of claim 9 further including a controller electrically connected with a switch that, when actuated, causes the controller to lower the platen mounting plate from the raised position towards the containers, the controller also electrically connected with a proximity sensor adapted to detect when the chime of one of the containers reaches a predetermined position with respect to the platen, the controller then raising the platen mounting plate to the raised position.

11. The system of claim 10 wherein the proximity sensor is a laser distance sensor mounted with the platen or platen mounting plate and adapted to return a distance range between the laser distance sensor and the lid of one of the containers.

12. The system of claim 9 further including at least one vertically adjustable mechanical stop, wherein the platen mounting plate contacts the mechanical stop when the carrier support and the platen reach the lowered position.

13. A system for packaging two or more containers of the type having a body, a neck, and a lid with a chime, the chimes of the containers all aligned in a horizontal plane, the system comprising:

a carrier having two or more apertures each for receiving the chime and neck of one of the containers, each aperture having a plurality of tabs formed at an inside edge thereof, each tab configured for bending upward when contacting the chime of one of the containers, each tab having a length and a thickness;

a platen having apertures for pressing the carrier down uniformly onto the containers, each aperture having a gap between an inside aperture wall and the chime of one of the containers;

a carrier support configured for maintaining the carrier in a flat configuration, the carrier support configured to contact at least a portion of a bottom side of the carrier;

whereby with the carrier supported with the carrier support, the platen presses the carrier onto the containers uniformly, the tabs of the carrier deforming upwardly substantially simultaneously to pass the chimes of the containers, each tab abutting a lower edge of the chime of one of the containers to hold the containers together with the carrier, the platen thereafter being withdrawn from the carrier and the containers to release the carrier and the containers.

14. The system of claim 13 wherein a corner between a bottom surface of the platen and the inside aperture wall of each aperture of the platen includes a radius between 0.03125 inches and 0.09375 inches.

15. The system of claim 13 wherein the gap between the inside aperture wall of each aperture of the platen and the chime of one of the containers engaged with the aperture of the platen is between 0.030 inches and 0.050 inches.

16. The system of claim 13 wherein a ratio of the thickness of each tab to the length of the tab is between 0.448 and 0.100.

17. The system of claim 16 wherein the manual applicator includes a skirt having a slot therein for receiving the carrier therethrough to engage the carrier support.

18. The system of claim 13 wherein each tab of each aperture of the carrier has a trapezoidal shape, gaps formed between the tabs being substantially triangular in shape.

19. The system of claim 13 wherein a manual applicator includes the carrier support integrally formed with the platen.

20. The system of claim 13 wherein the carrier support includes at least one carrier retainer plate movable between an engaged position wherein the at least one carrier retainer plate engages and supports the carrier, and a disengaged position wherein the at least one carrier retainer plate is retracted away from and disengages from the carrier, each carrier retainer plate fixed with a carrier mount.

21. The system of claim 20 further including at least a pair of guides orthogonally fixed with a base, the carrier mount having at least a pair of slide mechanisms each engaging one of the guides, the platen fixed with a platen mounting plate that also includes at least a pair of the slide mechanisms each engaging one of the guides, the platen slidably fixed with the guides above the carrier retainer plates and the carrier mount;

whereby with the carrier retainer plates in the engaged position and engaged with the carrier, and with the containers each supported on the base and aligned to receive the carrier, the platen mounting plate is moved downward, guided by the guides, until the platen engages the carrier, the platen mounting plate and the carrier mount then moved downwardly together until the tabs of the apertures of the carrier contact the chimes of the containers, the tabs of the apertures of the carrier being bent upward under downward pressure from the platen until each tab engages the neck and the lower edge of the chime of one of the containers, the carrier retainer plates then being retracted to release the carrier from the carrier support, the carrier mount and platen mounting plate thereafter being raised to clear the carrier and the containers such that the carrier and the containers can be removed from the semi-automatic apparatus.

22. The system of claim 21 further including at least one upper container guide projecting downwardly from the carrier mount and adapted to contact at least one of the containers as the carrier is lowered towards the containers to properly position the containers with respect to the carrier.

23. The system of claim 21 further including at least one linear actuator fixed with the platen mounting plate and adapted to raise and lower the platen mounting plate and platen between a raised position wherein the platen and carrier support clear the containers, and a lowered position wherein the carrier and platen engage the containers.

24. The system of claim 23 further including a controller electrically connected with a switch that, when actuated, causes the controller to lower the platen mounting plate from the raised position towards the containers, the controller also electrically connected with a proximity sensor adapted to detect when the chime of one of the containers reaches a predetermined position with respect to the platen, the controller then raising the platen mounting plate to the raised position.

25. The system of claim 24 wherein the proximity sensor is a laser distance sensor mounted with the platen or platen mounting plate and adapted to return a distance range between the laser distance sensor and the lid of one of the containers.

26. The system of claim 24 further including at least one vertically adjustable mechanical stop, wherein the platen mounting plate contacts the mechanical stop when the carrier support and the platen reach the lowered position.

27. The system of claim 13 wherein the carrier support contacts the bottom side of the carrier of each corner of the carrier.

28. A method of packaging two or more containers of the type having a body, a neck, and a lid with a chime, comprising the steps:

providing a carrier having two or more apertures each for receiving the chime and neck of one of the containers, each aperture having a plurality of tabs formed at an inside edge thereof, each tab configured for bending upward when contacting the chime of one of the containers, each tab having a length and a thickness;

providing a platen having apertures for pressing the carrier down uniformly onto the containers, each aperture having a gap between an inside aperture wall and the chime of one of the containers; and a carrier support configured for maintaining the carrier in a flat configuration;

inserting the carrier into the carrier support, the carrier support contacting at least a portion of a bottom side of the carrier to hold the carrier onto the carrier support;

positioning the containers below the platen and carrier with the chimes of each container in a common horizontal plane;

pressing down the platen so that the carrier is pushed onto the containers uniformly, the tabs of the carrier deforming upwardly substantially simultaneously to pass the chimes of the containers, each tab abutting a lower edge of the chime of one of the containers to hold the containers together with the carrier;

withdrawing the platen from the carrier and the containers to release the carrier and the containers.

29. The method of claim 28 further including the steps:

providing a semi-automatic apparatus for housing the platen and the carrier support, wherein the carrier support includes at least one carrier retainer plate movable between an engaged position wherein the at least one carrier retainer plate engages and supports the carrier, and a disengaged position wherein the at least one carrier retainer plate is retracted away from and disengages from the carrier, each carrier retainer plate fixed with a carrier mount; at least a pair of guides orthogonally fixed with a base, the carrier mount having at least a pair of slide mechanisms each engaging one of the guides, the platen fixed with a platen mounting plate that also includes at least a pair of the slide mechanisms each engaging one of the guides, the platen slidably fixed with the guides above the carrier retainer plates and the carrier mount; at least one linear actuator fixed with the platen mounting plate and adapted to raise and lower the platen mounting plate and platen between a raised position wherein the platen and carrier support clear the containers, and a lowered position wherein the carrier and platen engage the containers;

setting the carrier retainer plates in the engaged position to engage the carrier; and retracting the carrier retainer plates to release the carrier from the carrier support once the tabs of the carrier are engaged with each container.

* * * * *